US010704810B2

(12) United States Patent
Snell et al.

(10) Patent No.: US 10,704,810 B2
(45) Date of Patent: Jul. 7, 2020

(54) STEAM TURBINE DRIVEN CENTRIFUGAL HEAT PUMP

(71) Applicant: JOHNSON CONTROLS TECHNOLOGY COMPANY, Holland, MI (US)

(72) Inventors: Paul W. Snell, York, PA (US); Eric John Smyder, York Haven, PA (US); Dale M. Unger, York, PA (US)

(73) Assignee: Johnson Controls Technology Company, Auburn Hills, MI (US)

( * ) Notice: Subject to any disclaimer, the term of this patent is extended or adjusted under 35 U.S.C. 154(b) by 1102 days.

(21) Appl. No.: 14/650,598

(22) PCT Filed: Dec. 12, 2014

(86) PCT No.: PCT/US2014/069918
§ 371 (c)(1),
(2) Date: Jun. 9, 2015

(87) PCT Pub. No.: WO2015/089362
PCT Pub. Date: Jun. 18, 2015

(65) Prior Publication Data

US 2016/0265815 A1 Sep. 15, 2016

Related U.S. Application Data

(60) Provisional application No. 61/915,227, filed on Dec. 12, 2013.

(51) Int. Cl.
*F25B 11/00* (2006.01)
*F25B 49/02* (2006.01)
(Continued)

(52) U.S. Cl.
CPC ..... *F25B 11/00* (2013.01); *F25B 1/04* (2013.01); *F25B 1/053* (2013.01); *F25B 27/00* (2013.01);
(Continued)

(58) Field of Classification Search
CPC ..... F04D 27/0253; F04D 27/0269; F04D 27/0246; F04D 29/06
See application file for complete search history.

(56) References Cited

U.S. PATENT DOCUMENTS 3,330,335 A 7/1967 Leonard, Jr.
6,772,599 B2 8/2004 Bodell, II et al.
(Continued)

FOREIGN PATENT DOCUMENTS

EP 1762792 A1 3/2007
KR 20110045574 A 5/2011
KR 101141422 B1 7/2012

OTHER PUBLICATIONS

KR Office Action for KR Application No. 10-2016-7006823 dated Dec. 15, 2016; 5 Pages.
(Continued)

*Primary Examiner* — Nelson J Nieves
*Assistant Examiner* — Meraj A Shaikh
(74) *Attorney, Agent, or Firm* — Fletcher Yoder, P.C.

(57) ABSTRACT

A centrifugal heat pump system includes a steam system with a steam supply, a steam turbine and a steam condenser connected in a steam loop; and a refrigerant system including a first compressor and a second compressor, a refrigerant condenser, and an evaporator connected in a refrigerant loop. The steam turbine includes a rotary drive shaft disposed axially and extending from a first end and a second end of the steam turbine. A sump system collects and redistributes oil or other lubricating fluid. The first compres-
(Continued)

sor is coupled by a first coupling device to the first end of the steam turbine drive shaft and the second compressor is coupled by a second coupling device to the second end of the steam turbine drive shaft. The first and second compressors are connected in parallel in the refrigerant loop and controlled to share a cooling load equally.

20 Claims, 22 Drawing Sheets

(51) Int. Cl.

| | |
|---|---|
| ***F25B 31/02*** | (2006.01) |
| ***F25B 1/04*** | (2006.01) |
| ***F25B 31/00*** | (2006.01) |
| ***F25B 1/053*** | (2006.01) |
| ***F25B 27/00*** | (2006.01) |
| ***F25B 41/00*** | (2006.01) |
| *F25B 1/10* | (2006.01) |

(52) U.S. Cl.
CPC ..... *F25B 31/002* (2013.01); *F25B 31/004* (2013.01); *F25B 31/026* (2013.01); *F25B 41/00* (2013.01); *F25B 49/025* (2013.01); *F25B 1/10* (2013.01); *F25B 2339/047* (2013.01); *F25B 2341/0016* (2013.01); *F25B 2341/0661* (2013.01); *F25B 2400/075* (2013.01)

(56) References Cited

U.S. PATENT DOCUMENTS

| | | | | |
|---|---|---|---|---|
| 7,240,515 | B2 | 7/2007 | Conry | |
| 7,328,587 | B2 | 2/2008 | Shaffer et al. | |
| 7,421,853 | B2 * | 9/2008 | Shaffer | F04D 27/0246 60/239 |
| 7,421,854 | B2 * | 9/2008 | Shaffer | F04D 27/0246 60/239 |
| 8,037,713 | B2 | 10/2011 | Haley et al. | |
| 8,640,491 | B2 * | 2/2014 | Shoulders | F25B 31/004 208/184 |
| 2003/0043542 | A1 * | 3/2003 | Monfarad | H04L 23/427 361/679.54 |
| 2004/0025523 | A1 * | 2/2004 | Bodell, II | F04D 27/0253 62/228.1 |
| 2005/0160749 | A1 | 7/2005 | Shaffer et al. | |
| 2007/0193301 | A1 | 8/2007 | Andres | |
| 2007/0295025 | A1 * | 12/2007 | Minami | F25B 27/00 62/513 |
| 2009/0102467 | A1 * | 4/2009 | Snell | G01D 5/145 324/207.25 |
| 2011/0048046 | A1 * | 3/2011 | Sommer | F04D 17/12 62/228.1 |
| 2011/0094251 | A1 | 4/2011 | Kim et al. | |
| 2016/0003510 | A1 * | 1/2016 | De Larminat | F25B 31/004 62/470 |

OTHER PUBLICATIONS

Korean Office Action for KR Application No. 10-2016-7006823 dated Apr. 10, 2017, 12 pgs.
Extended European Search Report for EP Application No. 14870590.8 dated Aug. 10, 2017, 7 pgs.

* cited by examiner

STEAM TURBINE DRIVEN CENTRIFUGAL HEAT PUMP

CROSS-REFERENCES TO RELATED APPLICATIONS

This application is a continuation of U.S. Provisional Application No. 61/915,227, filed on Dec. 12, 2013, and entitled "STEAM TURBINE DRIVEN CENTRIFUGAL HEAT PUMP", the disclosure of which is hereby incorporated by reference in its entirety.

FIELD OF THE INVENTION

The present invention is directed to a steam turbine driven centrifugal heat pump. More specifically, the invention is directed to a double-ended steam turbine driving two single stage compressors in parallel operation.

BACKGROUND OF THE INVENTION

Heating and cooling systems for buildings or other structures typically maintain temperature control in a structure by circulating a fluid within coiled tubes such that passing another fluid over the tubes effects a transfer of thermal energy between the two fluids. A primary component in such a system is a compressor which receives a relatively cool, low pressure gas and discharges a hot, high pressure gas. Compressors include positive displacement compressors such as screw compressors, reciprocating compressors and scroll compressors, as well as compressors such as centrifugal compressors. Typically, an electric motor is used to power the compressor, although gas turbines have been used in large capacity systems. Recent advancements have resulted in the utilization of a variable speed motor to power a compressor such as a centrifugal compressor for use in large capacity systems and take advantage of chiller unit efficiencies during partial loading, when operation at a speed lower than full design load speed is desirable.

Another means to power a compressor in a high capacity system is a steam turbine. Steam turbines have been used less frequently to power compressors within a chiller unit, partially due to the excessive field work required to install the system and the unavailability of pre-packaged units that completely integrate the operation of the steam turbine, steam condenser and the chiller unit.

What is needed is a cost-effective, efficient and easily implemented method or apparatus for powering the compressor of a chiller unit with a steam turbine.

BRIEF SUMMARY OF THE INVENTION

In one embodiment, a centrifugal heat pump system includes a steam system with a steam supply, a steam turbine and a steam condenser connected in a steam loop; and a refrigerant system including a first compressor and a second compressor, a refrigerant condenser, and an evaporator connected in a refrigerant loop. The steam turbine includes a rotary drive shaft disposed axially and extending from a first end and a second end of the steam turbine. A sump system is provided to collect and redistribute oil or other lubricating fluid. The first compressor is coupled by a first coupling device to the first end of the steam turbine drive shaft and the second compressor is coupled by a second coupling device to the second end of the steam turbine drive shaft. The first and second compressors are connected in parallel in the refrigerant loop and controlled to share a cooling load equally.

One advantage of the invention is the ability to simultaneously drive dual compressors using a steam turbine. Another advantage is the ability to use magnetic probes and embedded magnets to determine whether a compressor has decoupled from the steam turbine driveshaft. Still another advantage is the ability to load share between two matching compressors. Alternative exemplary embodiments relate to other features and combinations of features as may be generally recited in the claims.

DETAILED DESCRIPTION OF THE INVENTION

Figure 1:
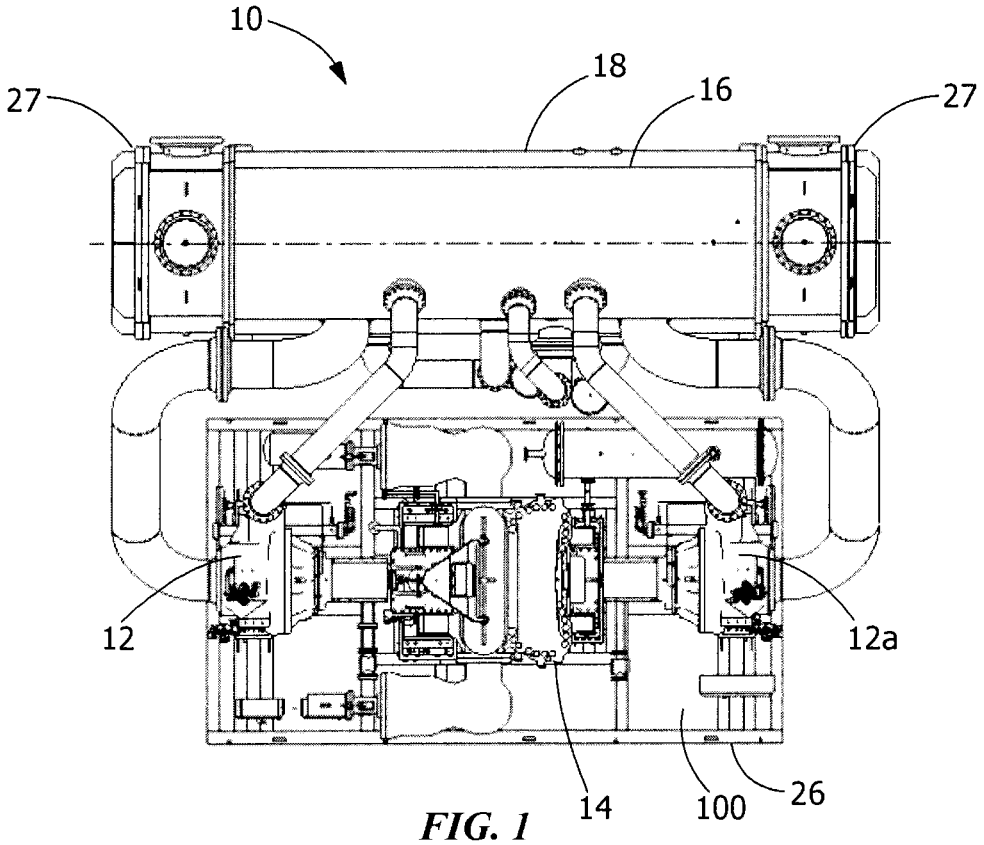
FIG. 1 is a plan view of a steam turbine driven chiller unit of the present invention.
Figure 6:
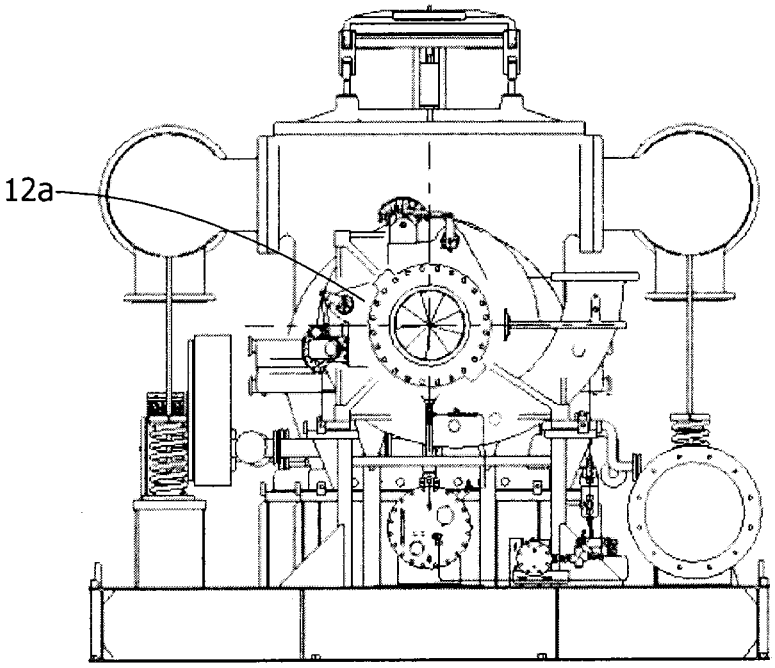
FIG. 6 is an end elevation view of the steam turbine driven chiller unit of FIG. 1.
Figure 2:
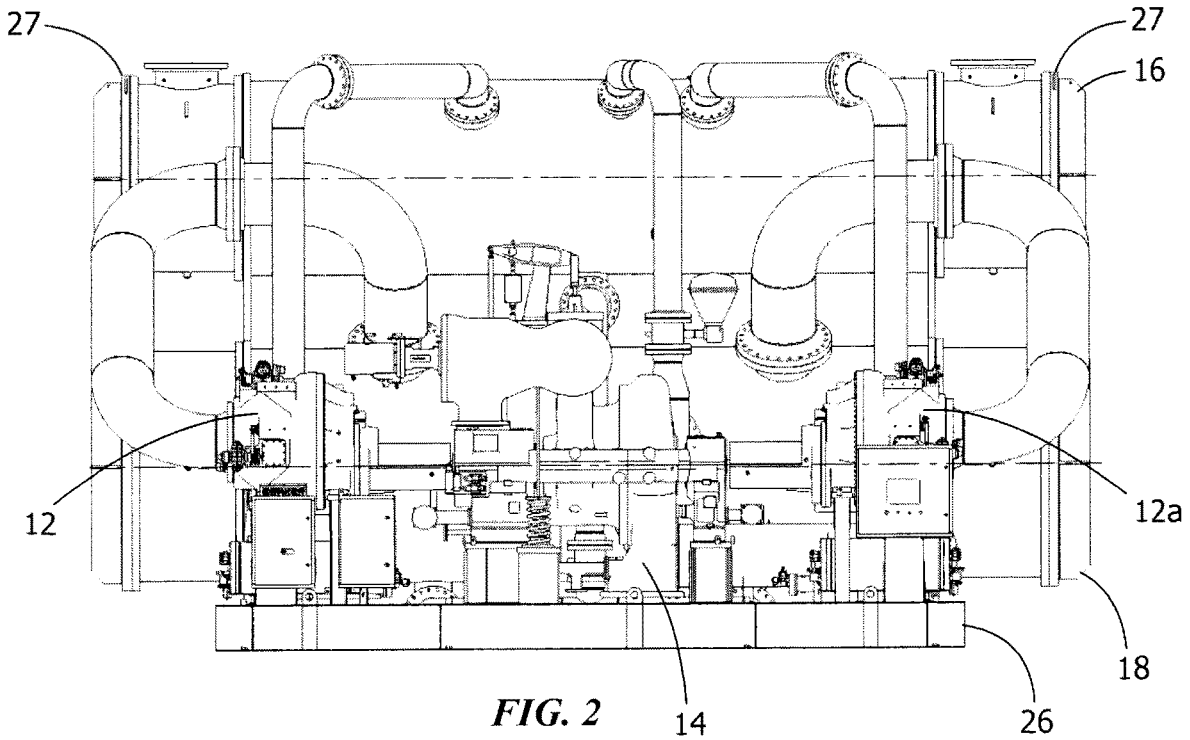
FIG. 2 is a side elevation view of the steam turbine driven chiller unit of FIG. 1.
Figure 3:
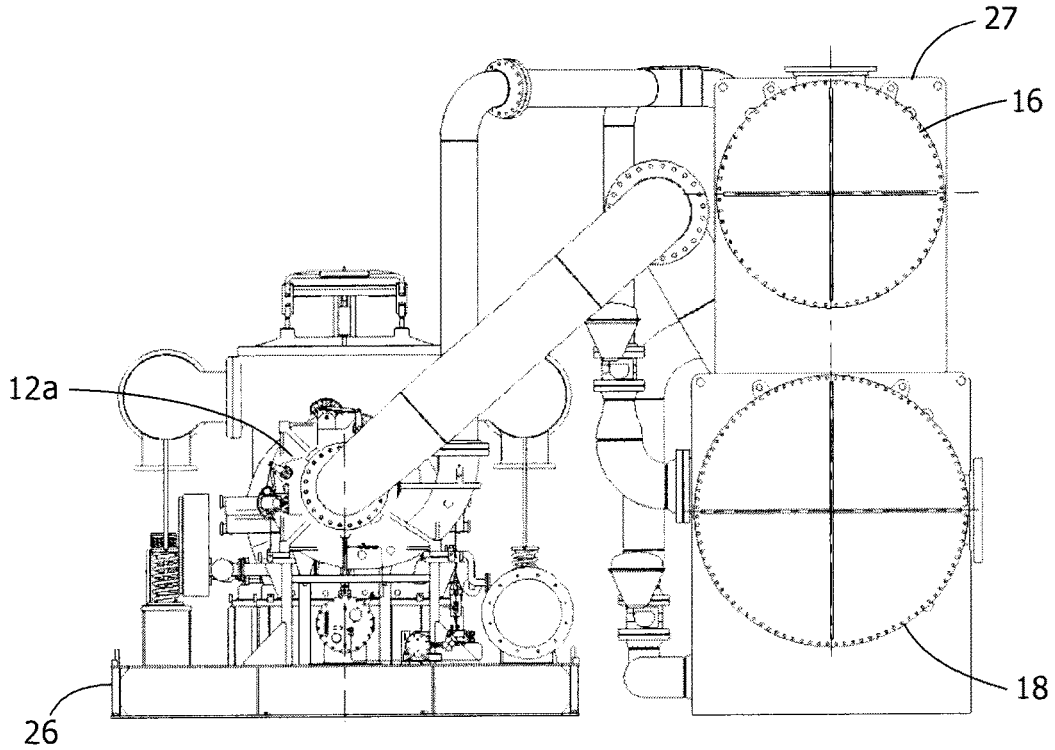
FIG. 3 is an end elevation view of the steam turbine driven chiller unit of FIG. 1.
Figure 4:
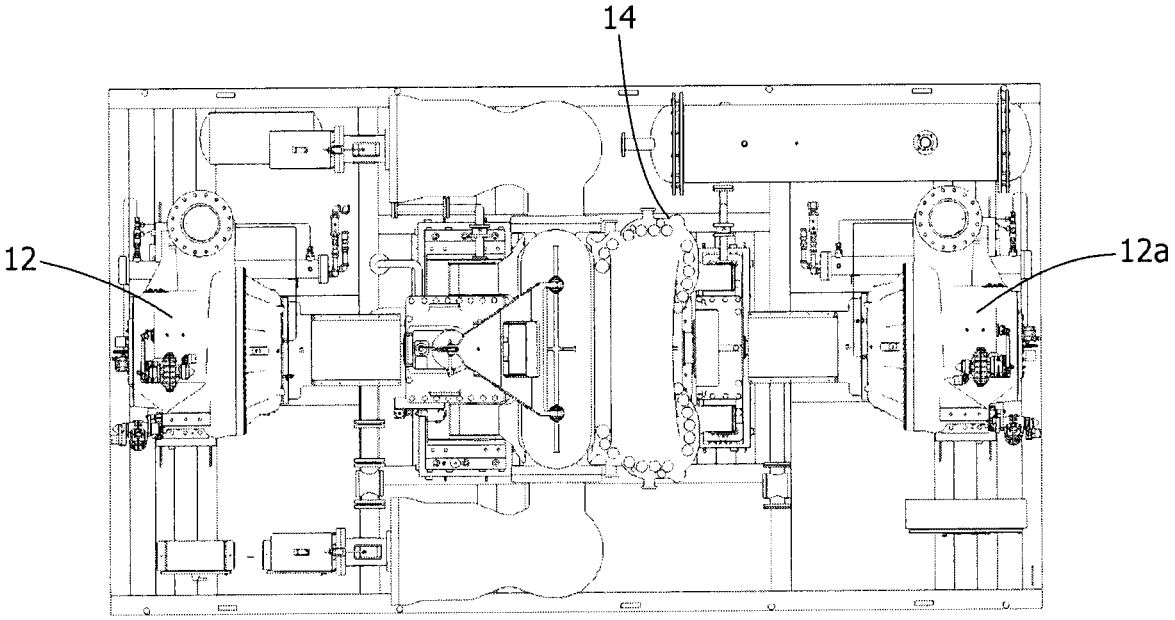
FIG. 4 is a partial plan view of a steam turbine driven chiller unit of FIG. 1.
Figure 5:
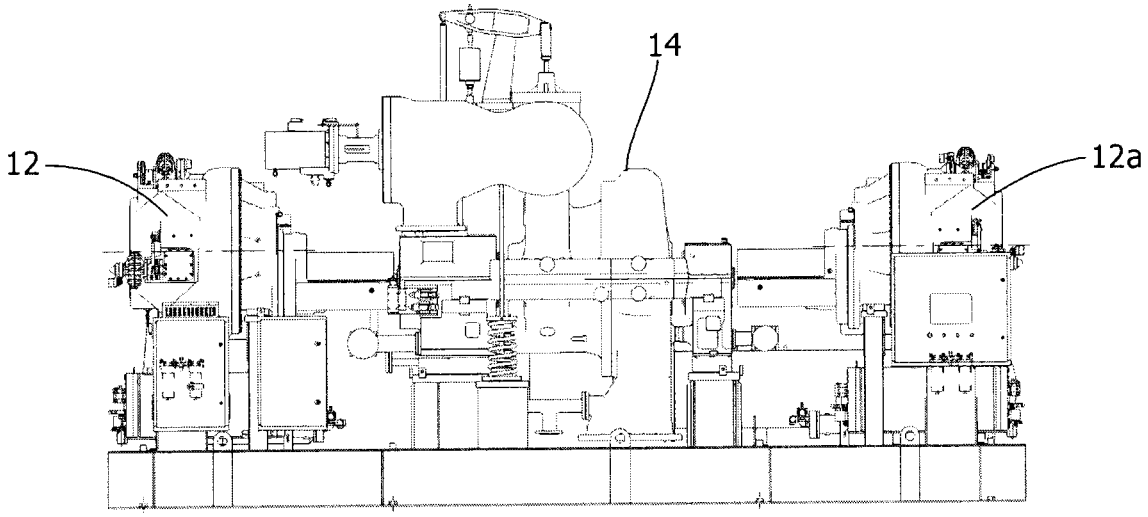
FIG. 5 is a partial side elevation view of the steam turbine driven chiller unit of FIG. 1.

A general system to which the invention is applied is illustrated, by means of example, in FIGS. 1-7. As shown, the HVAC, refrigeration, or chiller system 10 includes compressors 12, 12*a* disposed at opposite ends of a common shaft rotatably driven by a steam turbine 14, a refrigerant condenser 16, a water chiller or evaporator 18, a steam condenser 20, an expansion device 22 and a control panel or controller 90. Operation of control panel 90 will be discussed in greater detail below. The chiller system 10 further includes a compressor lubrication system 11 (FIG. 8) that can be used, if desired, to provide lubrication to the steam turbine 14. The conventional liquid chiller system 10 includes many other features that are not shown in FIGS. 1-7. These features have been purposely omitted to simplify the drawing for ease of illustration.

In the chiller system 10, the compressors 12, 12*a*, compress a refrigerant vapor and deliver it to the refrigerant condenser 16. The compressors 12, 12*a* are preferably centrifugal compressors, however any other suitable type of compressor can be used. The compressors 12, 12*a* are driven by the steam turbine 14, which steam turbine 14 can drive the compressors 12, 12*a* at either a single speed or at variable speeds. For example, steam turbine 14 may be a multistage, variable speed turbine that is capable of operating compressors 12, 12*a*, at a speed that more closely optimizes the efficiency of the chiller system 10. More preferably, steam turbine 14 is capable of driving compressors 12, 12*a* at speeds in a range of about 3200 rpm to about 4500 rpm. The supply of steam to the steam turbine 14 is preferably dry saturated steam within a range of about 90 to about 200 psi. The flow of steam supplied to steam turbine 14 can be modulated by a governor 48 to vary the speed of the steam turbine 14, and therefore vary the speed of compressors 12, 12*a* to adjust the capacity of the compressor by providing a greater or lower amount of refrigerant volumetric flow through the compressors 12, 12*a*. In another embodiment, the steam turbine 14 can drive the compressors 12, 12*a* at a single, constant speed and other techniques used to adjust the capacity of the compressors 12, 12*a*, e.g., the use of pre-rotation vanes (PRV) 80, or a hot gas bypass valve (HGV) 84, or combinations thereof.

The refrigerant vapor delivered by the compressors 12, 12*a* to the refrigerant condenser 16 enters into a heat exchange relationship with a fluid, e.g., air or water, and undergoes a phase change to a refrigerant liquid as a result of the heat exchange relationship with the fluid. In a preferred embodiment, the refrigerant vapor delivered to the refrigerant condenser 16 enters into a heat exchange relationship with a fluid, preferably water, flowing through a heat-exchanger coil connected to a cooling tower. The refrigerant vapor in the refrigerant condenser 16 undergoes a phase change to a refrigerant liquid as a result of the heat exchange relationship with the fluid in the heat-exchanger coil. The condensed liquid refrigerant from refrigerant condenser 16 flows through an expansion device 22 to the evaporator 18.

The evaporator 18 can include a heat-exchanger coil having a supply line 38 and a return line 40 connected to a cooling load. A secondary liquid, e.g., water, ethylene or propylene glycol mixture, calcium chloride brine or sodium chloride brine, travels into the evaporator 18 via the return line 40 and exits the evaporator 18 via the supply line 38. The liquid refrigerant in the evaporator 18 enters into a heat exchange relationship with the secondary liquid to lower the temperature of the secondary liquid. The refrigerant liquid in the evaporator 18 undergoes a phase change to a refrigerant vapor as a result of the heat exchange relationship with the secondary liquid. The vapor refrigerant in the evaporator 18 exits the evaporator 18 and returns to the compressors 12, 12*a* by a suction line to complete the cycle. It is to be understood that any suitable configuration of refrigerant condenser 16 and evaporator 18 can be used in the chiller system 10, provided that the appropriate phase change of the refrigerant in the refrigerant condenser 16 and evaporator 18 is obtained.

At the input or inlet to the compressors 12, 12*a* from the evaporator 18, there are one or more PRV 80 that control the flow of refrigerant to the compressors 12, 12*a*, and thereby control the capacity of the compressors 12, 12*a*. PRV 80 is positionable to any position between a substantially open position, wherein refrigerant flow is essentially unimpeded at a discharge end of compressors 12, 12*a*, and a substantially closed position, wherein refrigerant flow into compressors 12, 12*a* is restricted. It is to be understood that in the closed position, PRV 80 may not completely stop the flow of refrigerant into compressors 12, 12*a*. An actuator is used to open the PRV 80 to increase the refrigerant flowing through the compressors 12, 12*a* and thereby increase the cooling capacity of the system 10. Similarly, the actuator is used to close the PRV 80 to decrease the amount of refrigerant flow in the compressors 12, 12*a* and thereby decrease the cooling capacity of the system 10. The actuator for the PRV 80 can open and close the PRV 80 in either a continuous manner or in a stepped or incremental manner.

The chiller system 10 can also include a hot gas bypass connection and corresponding valve 84 that connects the high pressure side and the low pressure side of the chiller system 10. In the embodiment illustrated in FIG. 7, the hot gas bypass connection and HGV 84 connect the refrigerant condenser 16 and the evaporator 18 and bypass the expansion device 22. In another embodiment, the hot gas bypass connection and HGV 84 can connect the compressor suction line and the compressor discharge line. The HGV 84 is preferably used as a recirculation line for compressors 12, 12*a* to recirculate refrigerant gas from the discharge of compressors 12, 12*a*, via refrigerant condenser 16, to the suction of compressors 12, 12*a*, via evaporator 18. The HGV 84 can be adjusted to any position between a substantially open position, wherein refrigerant flow is essentially unimpeded, and a substantially closed position, wherein refrigerant flow is restricted. The HGV 84 can be opened and closed in either a continuous manner or in a stepped or incremental manner. The opening of the HGV 84 can increase the amount of refrigerant gas supplied to the compressor suction to prevent surge conditions from occurring in compressors 12, 12*a*.

With regard to the steam turbine system, a steam supply provides steam to the steam turbine 14. The steam from the steam supply preferably enters a moisture separator 64. In the moisture separator 64, moisture-laden steam from the steam supply enters and is deflected in a centrifugally downward motion. The entrained moisture in the steam is separated out by a reduction in the velocity of the steam flow. Separated moisture then falls through a moisture outlet (not shown) and dry saturated steam flows upward and exits through a steam outlet (not shown) where it flows toward a main steam inlet block valve 69. The main steam inlet block valve 69 can be positioned to control the amount of steam that flows toward a governor 48 during the slow roll ramp up to minimum rated speed at start up. The governor 48 is located in the steam supply line to regulate steam flow and is preferably located adjacent a steam inlet of steam turbine 14. The governor or governor valve 48 can be opened or closed in a continuous manner or in a stepped or incremental manner. Steam turbine 14 includes a steam inlet to receive the steam from the steam supply. The steam from the steam supply flows through the steam inlet and turns a rotatable turbine portion of the steam turbine 14 to extract the energy therefrom to turn a coupling 66 that interconnects the shafts (not shown) of steam turbine 14 and compressors 12, 12*a*. After rotating the turbine portion of the steam turbine 14, the steam then exits the steam turbine 14 through a steam exhaust.

In a preferred embodiment, the coupling 66 provides for a direct rotational connection between the steam turbine 14 and the compressors 12, 12*a*. In alternate embodiments, the coupling 66 can include one or more gearing arrangements (or other similar arrangements) to increase or decrease the relative rotational speeds between the steam turbine 14 and the compressors 12, 12*a*. In addition, one or both of the steam turbine 14 and compressors 12, 12*a* can also include an internal gearing arrangement connected to the coupling 66 to adjust the relative rotational speeds of the steam turbine 14 or compressors 12, 12*a*.

In another embodiment, each coupling 66 connecting compressors 12, 12*a* to the drive shaft of steam turbine 14 can be disconnected during operation of the chiller 10, such as upon encountering an emergency condition. Emergency conditions include, for example, a predetermined oil pressure loss, a predetermined change in thrust applied to the thrust bearings, and a predetermined sump oil temperature. In addition, it is desirable to have a way to verify that the couplings 66 have been disconnected from the drive shaft of steam turbine 14, such as with use of eddy-current sensors, also referred to as "proximity probes". An eddy-current sensor typically has an inductance coil that, when provided with a high frequency electrical current, generates a magnetic field. This magnetic field induces eddy-currents on a conductive target that is disposed within the magnetic field. The target may be stationary or moving into or through the magnetic field. These eddy-currents affect the amplitude of the magnetic field. The eddy-current sensor, in conjunction with signal-conditioning electronics, detects the changes in the magnetic field and generates an output signal that is proportional to the static distance or gap between the sensor and the target. The output signal is also proportional in relation to the dynamic change in distance, i.e., movement or vibration, with respect to the sensor location. As a result of using a proximity probe, for example, with an insert having different magnetic properties than the thrust collar 44 in which the insert is installed, the rotational speed of the shaft could be determined, and more precisely in this application, whether the rotational speed of the compressor 12, 12*a* is decreasing, which would occur as a result of the coupling 66 successfully disconnecting the compressors 12, 12*a* from the steam turbine 14. In one embodiment, the coupling 66 would be reconnected once the steam turbine shaft was no longer rotating.

In other embodiments, the coupling 66 can be an electromagnetic coupling, a pneumatic coupling (i.e., air clutch) or other suitable type of coupling system.

In addition, a turbine steam ring drain valve 63 is provided to permit the operator to remove any condensate from the steam turbine 14 during the slow roll warm up of the steam turbine 14. A gland seal steam supply valve 67 can be used to admit steam to the gland seal supply pressure regulating valve during a slow roll. A steam condenser vacuum pump 65 evacuates the steam condenser and turbine exhaust to a desired vacuum that is required for the steam turbine 14 to produce the power required by the compressors 12, 12*a*.

The exhausted steam from steam turbine 14 flows to steam condenser 20. Within steam condenser 20, the steam/condensate flow from the steam turbine 14 enters into a heat exchange relationship with cooling water flowing through steam condenser 20 to cool the steam. Steam condenser 20 includes a hotwell 43 connected to a condensate recirculation system 46. Condensate recirculation system 46 includes a condensate outlet in the hotwell 43 that can provide or transfer condensate from the hotwell 43 to a condensate pump 62. From the condensate pump 62, the condensate is selectively provided to a condensate recirculation inlet of the steam condenser 20 and/or to a condensate return inlet of the steam supply. In this manner, condensate recirculation system 46 can maintain a preselected flow of condensate through steam condenser 20 and return condensate to the steam supply for further generation of steam.

As discussed above, cooling water from a cooling tower or other source is preferably routed to the refrigerant condenser 16 by a cooling water supply line 70. The cooling water is circulated in the refrigerant condenser 16 to absorb heat from the refrigerant gas. The cooling water then exits the refrigerant condenser 16 and is routed or provided to the steam condenser 20. The cooling water is circulated in the steam condenser 20 to further absorb heat from the steam exhausted from the steam turbine 14. The cooling water flowing from the steam condenser 20 is directed to the cooling tower by a cooling water return line 76 to reduce the temperature of the cooling water, which then may be returned to refrigerant condenser 16 to repeat the cycle.

Typically, the steam condenser 20 operates at a greater temperature than the refrigerant condenser 16. By routing the cooling water through refrigerant condenser 16 and then the steam condenser 20, in a series or serial arrangement, the low temperature cooling water can absorb heat within the refrigerant condenser 16 then be transferred to the steam condenser 20 to absorb additional heat. In a preferred embodiment, this ability to use the cooling water to cool both the refrigerant condenser 16 and the steam condenser 20 can be accomplished by selecting the appropriate refrigerant condenser 16 and steam condenser 20. The refrigerant condenser 16 is selected such that the outlet cooling water temperature from the refrigerant condenser 16 is lower than the maximum acceptable inlet cooling water temperature for the steam condenser 20. This series or serial flowpath for condenser (refrigerant and steam) cooling water within the chiller system 10 can reduce the need for multiple supplies of cooling water, and can reduce the total amount of cooling water required for the chiller system 10.

Figure 25:
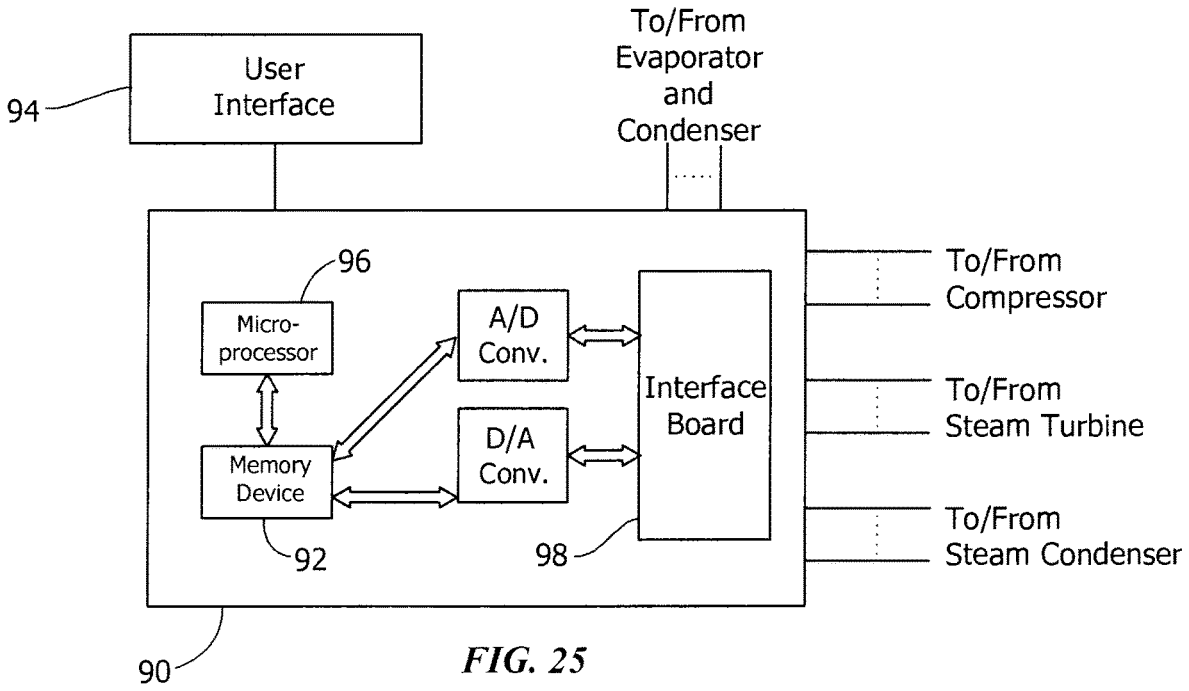
FIG. 25 is a schematic representation of the control system of the chiller unit of FIG. 1.

As illustrated in FIG. 25 the control panel 90 includes analog to digital (A/D) and digital to analog (D/A) converters, a microprocessor 96, a non-volatile memory or other memory device 92, and an interface board 98 to communicate with various sensors and control devices of chiller system 10. In addition, the control panel 90 can be connected to or incorporate a user interface 94 that permits an operator to interact with the control panel 90. The operator can select and enter commands for the control panel 90 through the user interface 94. In addition, the user interface 94 can display messages and information from the control panel 90 regarding the operational status of the chiller system 10 for the operator. The user interface 94 can be located locally to the control panel 90, such as being mounted on the chiller system 10 or the control panel 90, or alternatively, the user interface 94 can be located remotely from the control panel 90, such as being located in a separate control room apart from the chiller system 10.

Microprocessor 96 executes or uses a single or central control algorithm or control system to control the chiller system 10 including the compressors 12, 12*a*, the steam turbine 14, the steam condenser 20 and the other components of the chiller system 10. In one embodiment, the control system can be a computer program or software having a series of instructions executable by the microprocessor 96. In another embodiment, the control system may be implemented and executed using digital and/or analog hardware by those skilled in the art. In still another embodiment, control panel 90 may incorporate multiple controllers, each performing a discrete function, with a central controller that determines the outputs of control panel 90. If hardware is used to execute the control algorithm, the corresponding configuration of the control panel 90 can be changed to incorporate the necessary components and to remove any components that may no longer be required.

The control panel 90 of the chiller system 10 can receive many different sensor inputs from the components of the chiller system 10. Some examples of sensor inputs to the control panel 90 are provided below, but it is to be understood that the control panel 90 can receive any desired or suitable sensor input from a component of the chiller system 10. Some inputs to the control panel 90 relating to the compressors 12, 12*a* can be from a compressor discharge temperature sensor, a compressor oil temperature sensor, a compressor oil supply pressure sensor and a pre-rotation vane position sensor. Some inputs to the control panel 90 relating to the steam turbine 14 can be from a turbine shaft end bearing temperature sensor, a turbine governor end bearing temperature sensor, a turbine inlet steam temperature sensor, a turbine inlet steam pressure sensor, a turbine first stage steam pressure sensor, a turbine exhaust pressure sensor, a turbine speed sensor, and a turbine trip valve status sensor.

Some inputs to the control panel 90 relating to the steam condenser 20 can be from a hotwell condensate level sensor, a hotwell high level status sensor, and a hotwell low level status sensor. Some inputs to the control panel 90 relating to the refrigerant condenser 16 can be from an entering refrigerant condenser water temperature sensor, a leaving condenser water temperature sensor, a refrigerant liquid temperature sensor, a refrigerant condenser pressure sensor, a subcooler refrigerant liquid level sensor, and a refrigerant condenser water flow sensor. Some inputs to the control panel 90 relating to the evaporator 18 can be from a leaving chilled liquid temperature sensor, a return chilled liquid temperature sensor, an evaporator refrigerant vapor pressure sensor, a refrigerant liquid temperature sensor, and a chilled water flow sensor. In addition, other inputs to controller 90 include a HVAC&R demand input from a thermostat or other similar temperature control system.

Furthermore, the control panel 90 of the chiller system 10 can provide or generate many different control signals for the components of the chiller system 10. Some examples of control signals from the control panel 90 are provided below, but it is to be understood that the control panel 90 can provide any desired or suitable control signal for a component of the chiller system 10. Some control signals from the control panel 90 can include a turbine shutdown control signal, a compressor oil heater control signal, a variable speed oil pump control signal, a turbine governor valve control signal, a hotwell level control signal, a HGV control signal, a subcooler refrigerant liquid level control signal, a pre-rotation vane position control signal, and a steam inlet valve control signal. In addition, control panel 90 can send a turbine shutdown signal when either the technician has input a shutdown command into user interface 94, or when a deviation is detected from a preselected parameter recorded in memory device 92.

The central control algorithm executed by the microprocessor 96 on the control panel 90 preferably includes a capacity control program or algorithm to control the speed of the steam turbine 14, and thereby the speed of the compressors 12, 12*a*, to generate the desired capacity from compressors 12, 12*a* to satisfy a cooling load. The capacity control program can automatically determine a desired speed for steam turbine 14 and compressors 12, 12*a*, preferably in direct response to the leaving chilled liquid temperature in the evaporator 18, which temperature is an indicator of the cooling load demand on the chiller system 10. After determining the desired speed, the control panel 90 sends or transmits control signals to the appropriate steam turbine system components to change the flow of steam supplied to steam turbine 14, thereby regulating the speed of steam turbine 14.

The capacity control program can maintain selected parameters of chiller system 10 within preselected ranges. These parameters include turbine speed, chilled liquid outlet temperature, turbine power output, and anti-surge limits for minimum compressor speed and compressor pre-rotation vane position. The capacity control program employs continuous feedback from sensors monitoring various operational parameters described herein to continuously monitor and change the speed of turbine 14 and compressors 12, 12*a* in response to changes in system cooling loads. That is, as the chiller system 10 requires either additional or reduced cooling capacity, the operating parameters of the compressors 12, 12*a* in the chiller 10 are correspondingly updated or revised in response to the new cooling capacity requirement. To maintain maximum operating efficiency, the operating speed of the compressors 12, 12*a* can be frequently changed or adjusted by the capacity control algorithm. Furthermore, separate from system load requirements, the capacity control program also continuously monitors the refrigerant system pressure differential to optimize the volumetric flow rate of refrigerant in chiller system 10 and to maximize the resultant steam efficiency of steam turbine 14.

The central control algorithm also includes other algorithms and/or software that provide the control panel 90 with a monitoring function of various operational parameters for chiller system 10 during both startup and routine operation of chiller system 10. Undesirable operational parameters, such as low turbine speed, low turbine oil pressure, or low compressor oil pressure, can be programmed into the control panel 90 with a logic function to take appropriate remedial action, e.g., shutdown the chiller system 10 or de-coupling of steam turbine 14 and compressor 12, 12*a*, in the event that undesired, or beyond system design, parameters are detected. Additionally, the central control algorithm has preselected limits for many of the operational parameters of the chiller system 10 and can prevent a technician from manually operating the chiller system 10 outside of these limits.

Figure 26:
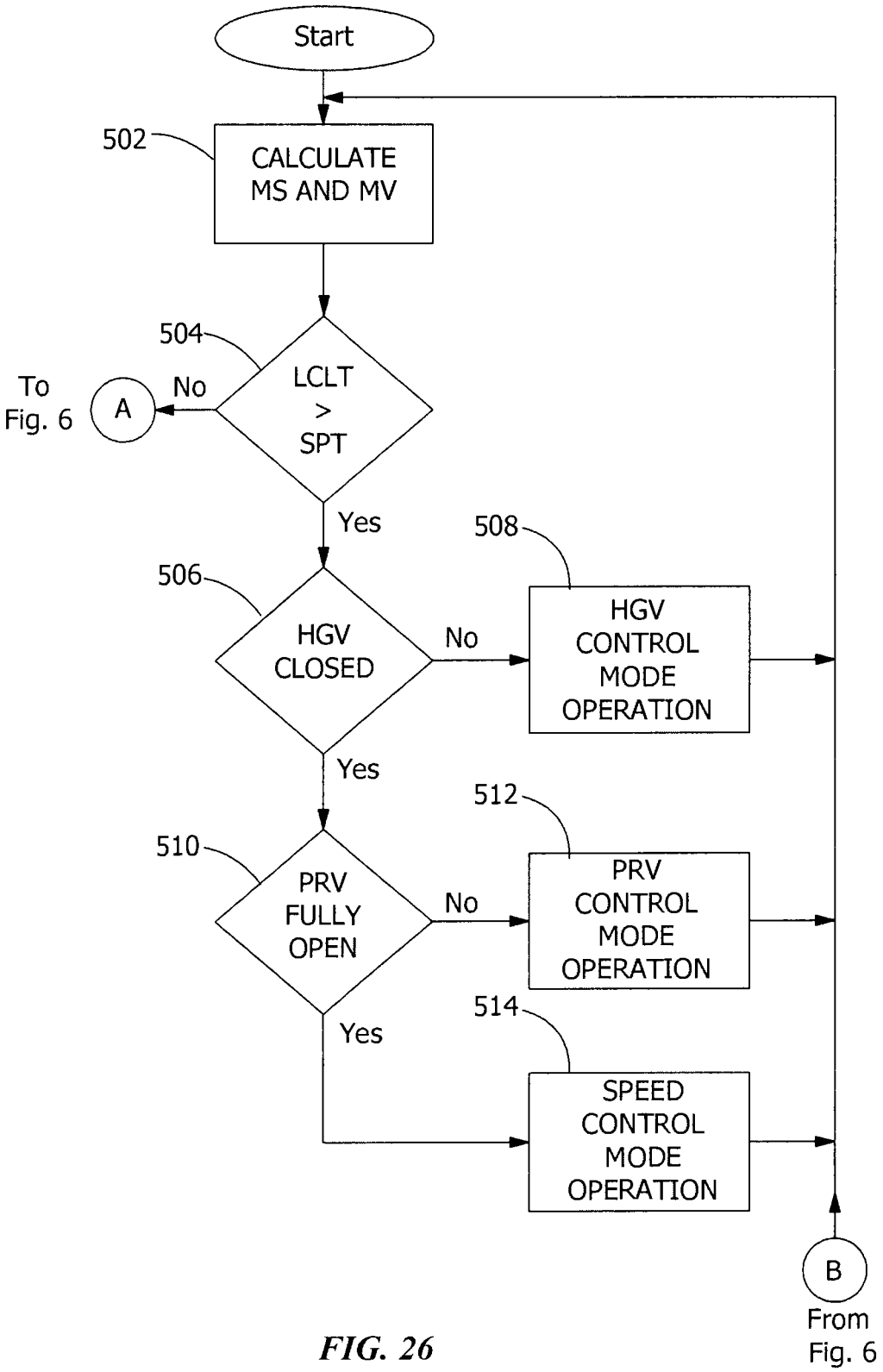
FIG. 26 is a schematic representation of a control system of the steam turbine driven chiller unit of the present invention.
Figure 27:
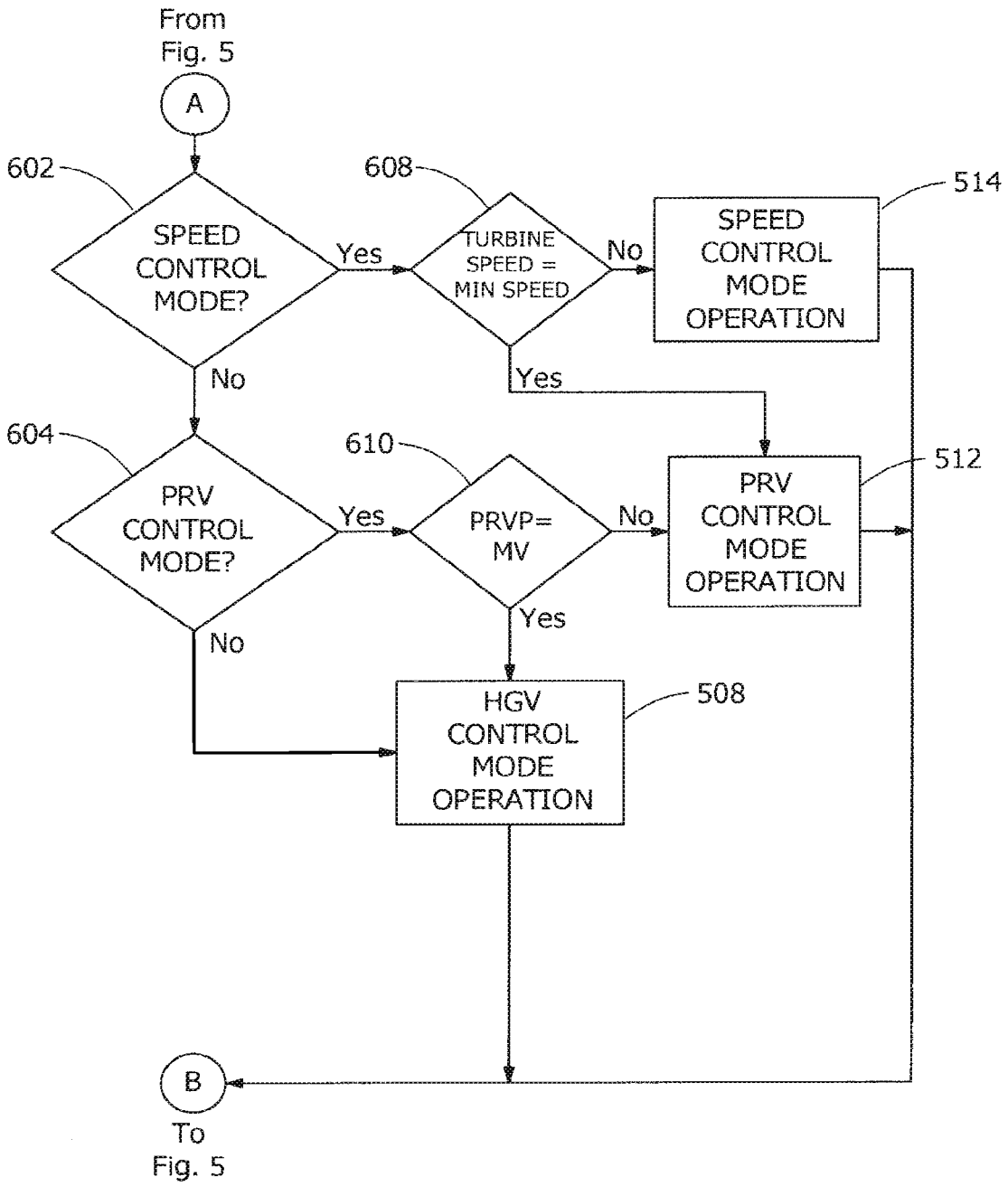
FIGS. 27 and 28 illustrate a flowchart of one embodiment of a control process of the present invention.
Figure 28:
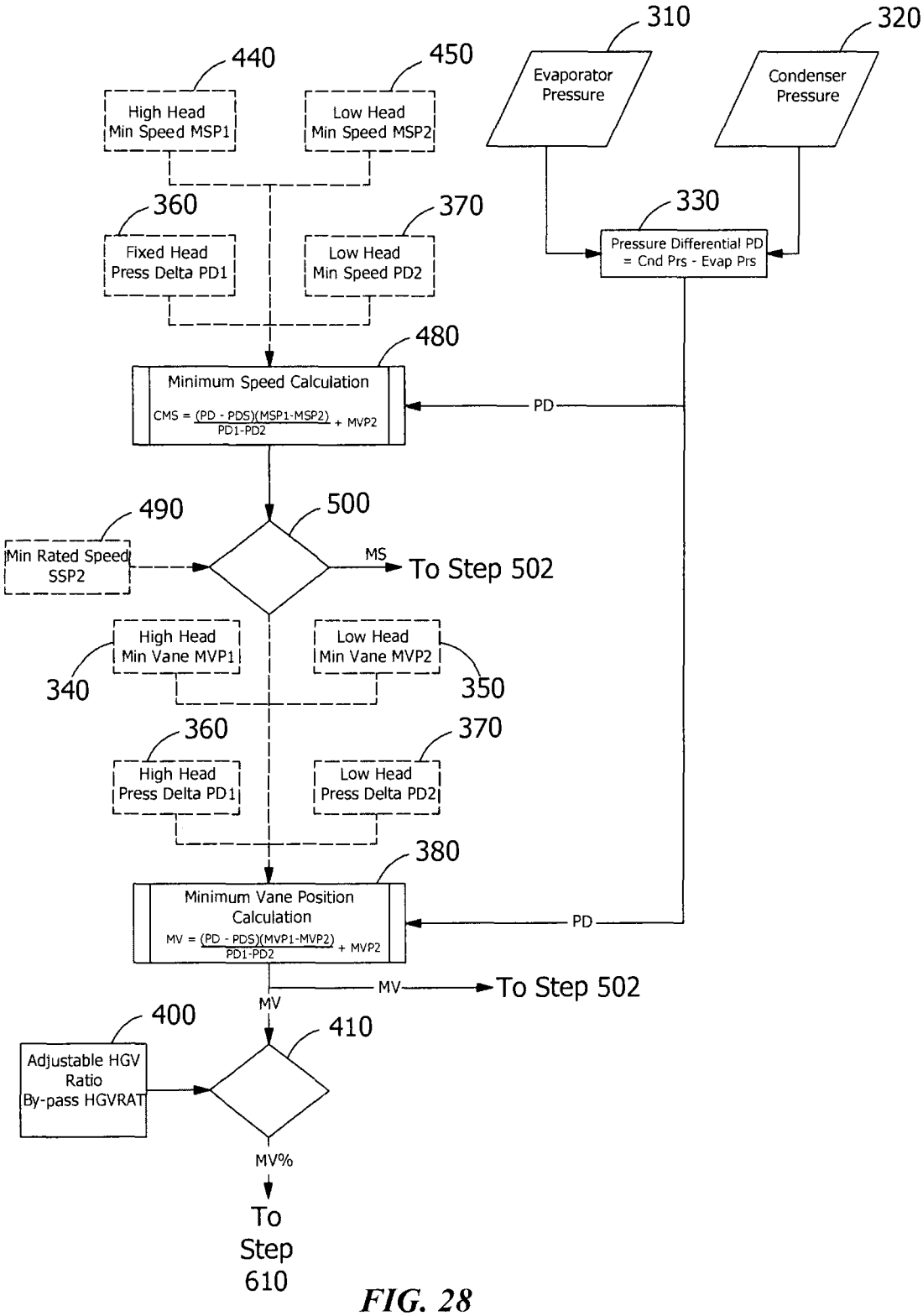
Figure 29A:
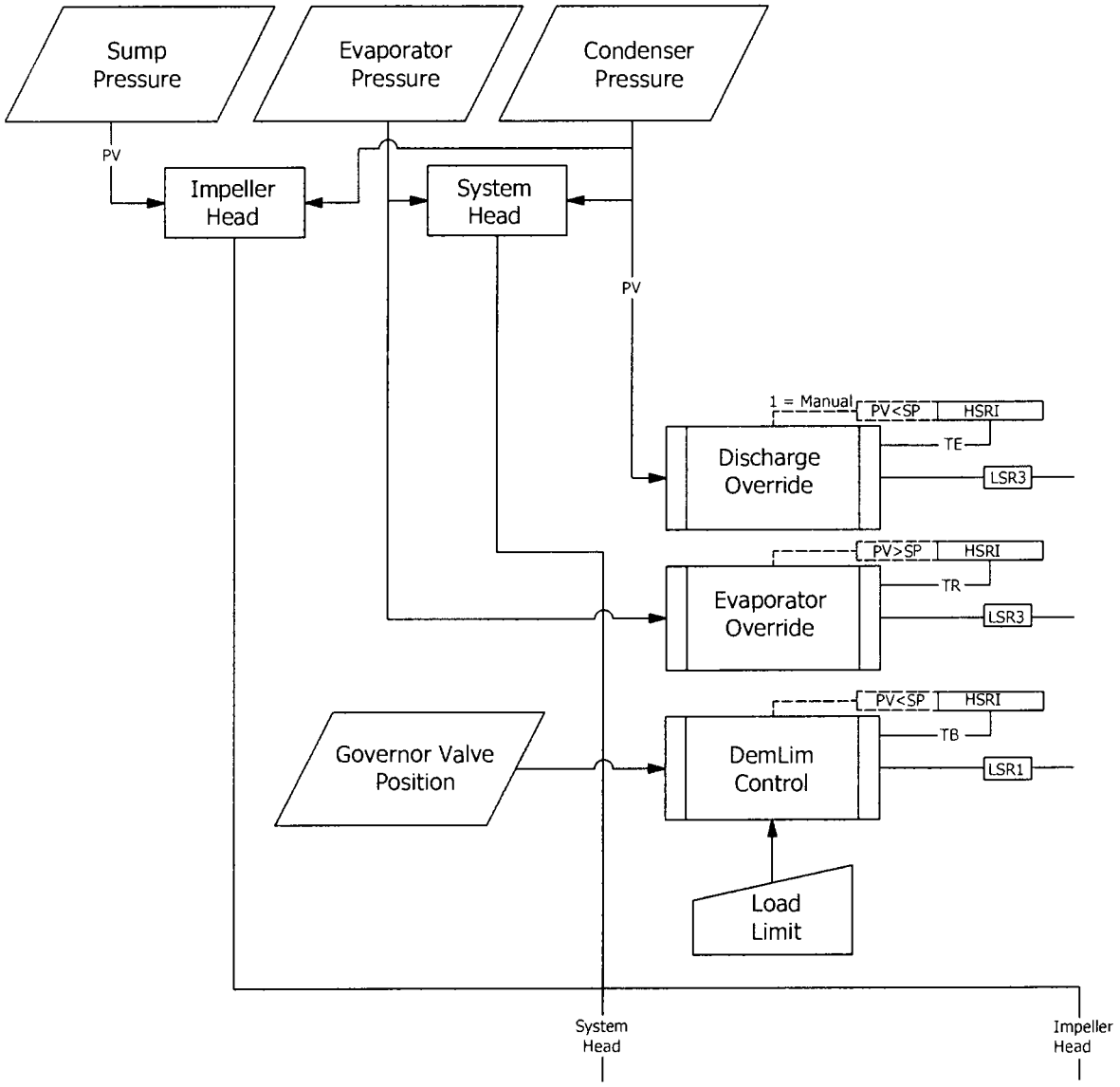
FIGS. 29A through 29D, an exemplary embodiment of a control scheme is shown for a steam turbine driven dual compressor system.
Figure 29B:
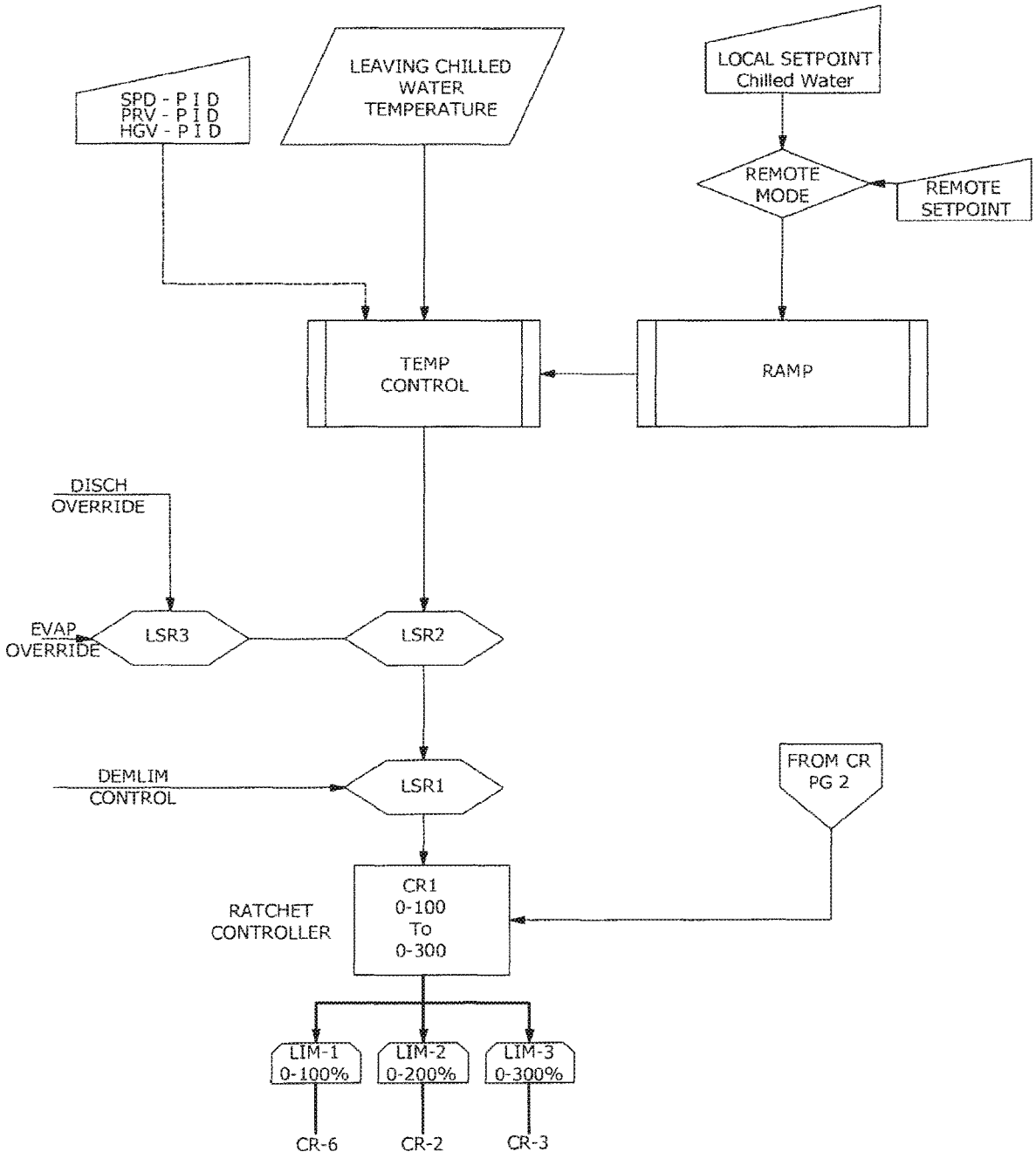
Figure 29C:
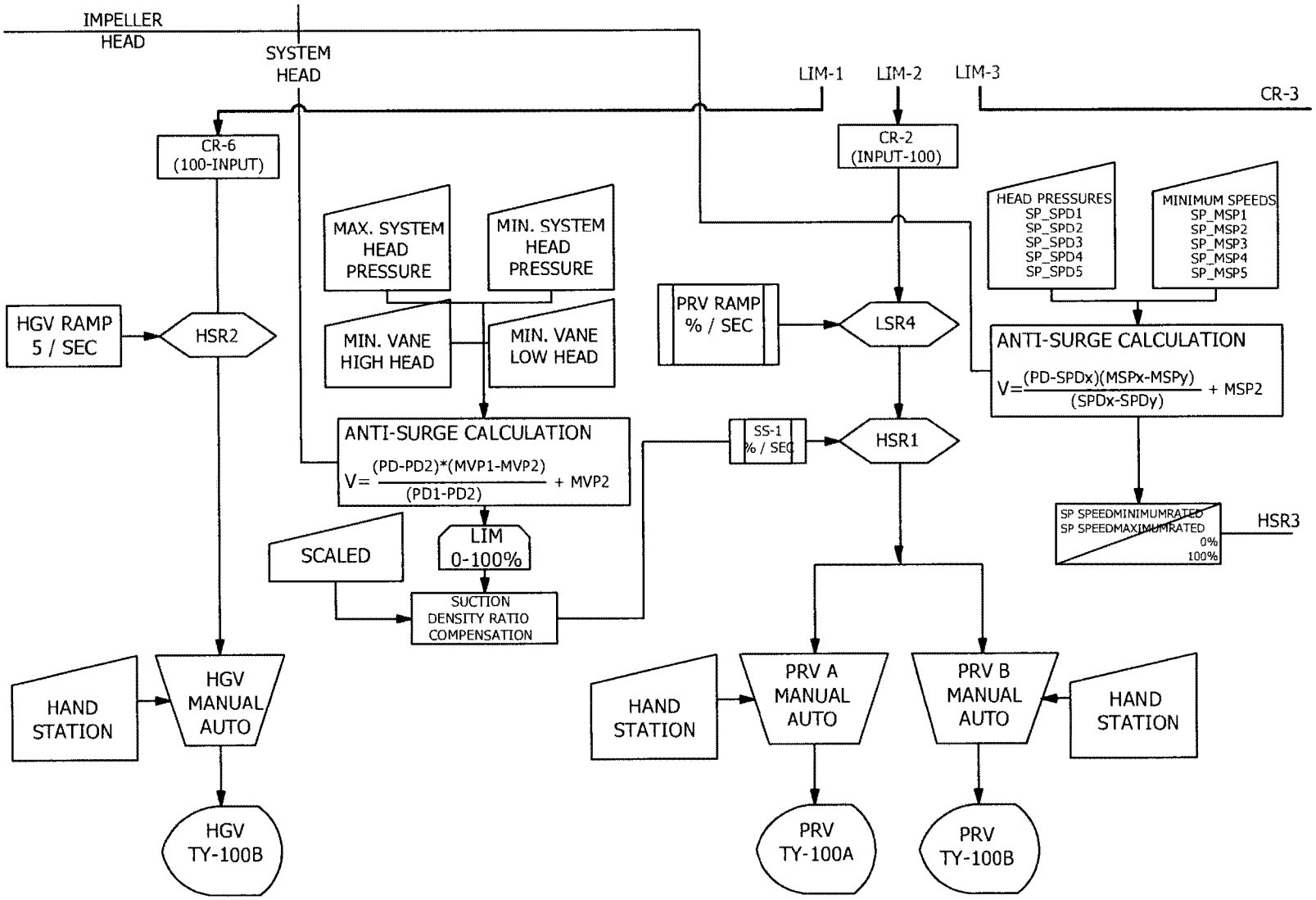
Figure 29D:
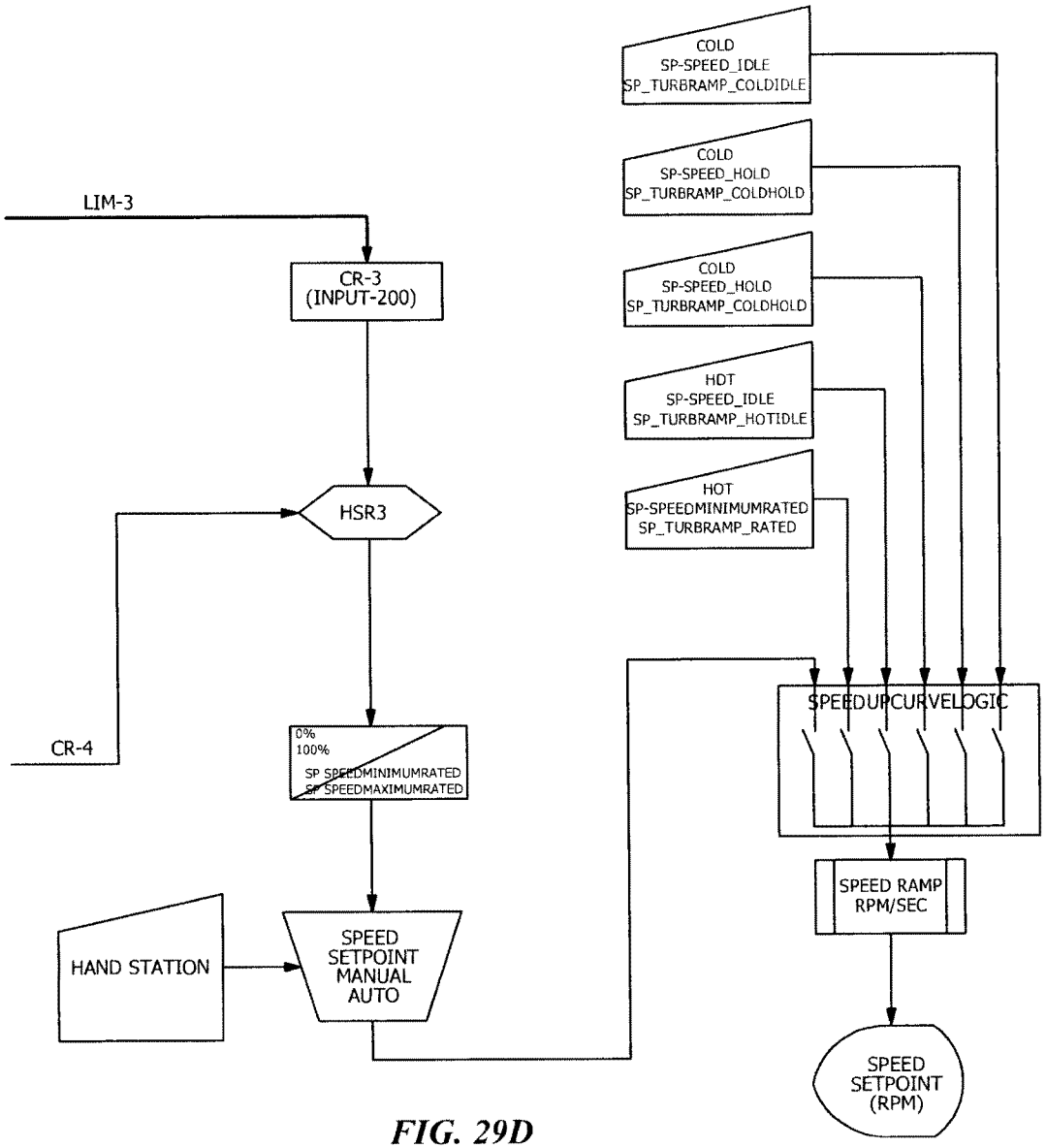

In a preferred embodiment, the capacity control program can control the speed of the turbine 14 (and the compressors 12, 12*a*), the position of the PRV 80 and the position of the HGV 84 in response to changes in the leaving chilled liquid temperature (LCLT) from the evaporator 18. FIGS. 26-28 illustrate an embodiment of the capacity control process for the capacity control program of the present invention. FIG. 26 generally illustrates the loading process for the system 10 and FIG. 27 generally illustrates the unloading process for the system 10. Referring now to FIG. 26, the process begins in step 502 by calculating the minimum turbine speed (MS) and the minimum pre-rotation vane position (MV) in response to the system pressure differential (PD), which is calculated by subtracting the evaporator pressure from the condenser pressure.

In the embodiments shown, steam turbine 14 includes two output shafts (not shown) for driving compressors 12, 12*a*, disposed at opposite ends. Compressors 12, 12*a* may be manufactured as mirror images of one another to provide symmetry located at the opposing ends of steam turbine 14, as they are attached to a common shaft and therefore must rotate in the same direction while facing opposite directions. Alternately, compressors 12, 12*a* can be attached to a common shaft facing the same direction, such that compressors 12, 12*a* can be identical to each other.

Another aspect of this disclosure is generally directed to reducing the amount of miscible refrigerant in lubricant in lubrication systems used in refrigeration. Alternately, a lubrication system having non-miscible refrigerant can be used in lubrication systems.

Figure 7:
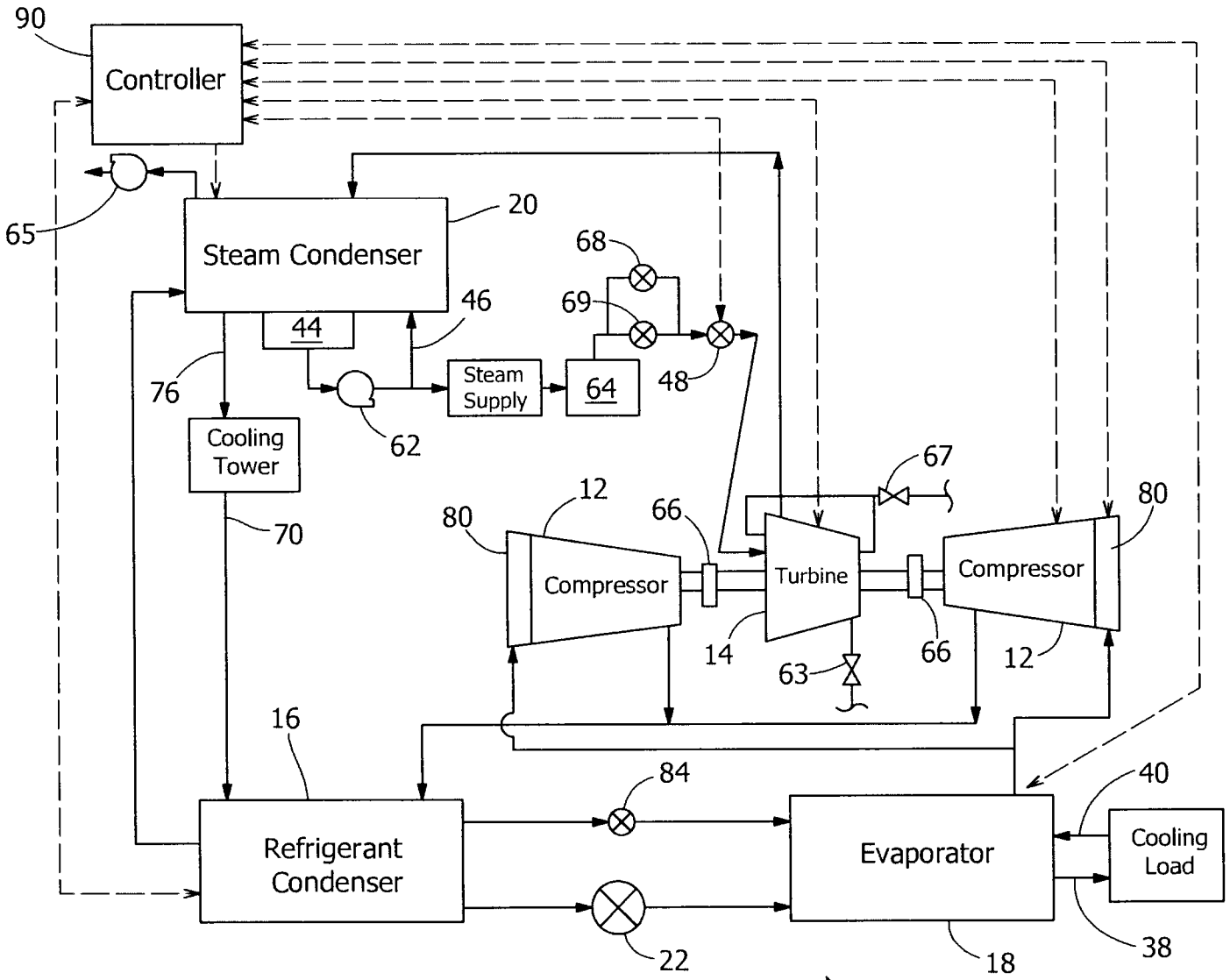
FIG. 7 is a schematic diagram of steam, refrigerant and cooling water flow for a steam turbine driven chiller unit of the present invention.
Figure 8:
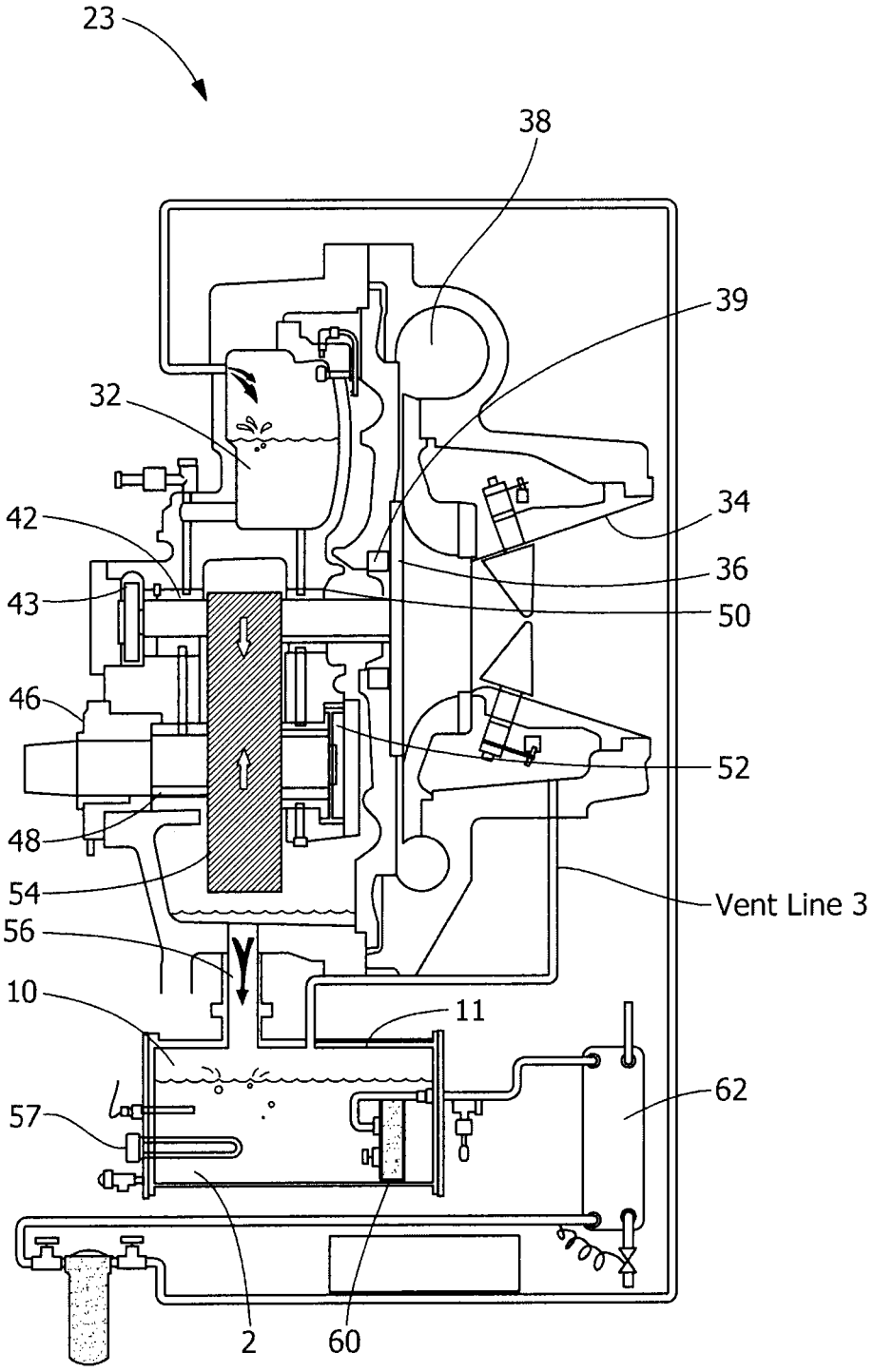
FIG. 8 Prior Art
FIG. 8 is a cross-sectional view of a prior art compressor depicting the associated sump system.

FIG. 8 is a cross-sectional view of a prior art centrifugal compressor and associated sump system. FIG. 8 depicts compressor 23 and oil sump 11. Some lubricating oil is retained in an auxiliary oil reservoir 32 intended to maintain some oil supply during coast down in the event of a power failure. Compressor 23 includes an inlet 34 which receives refrigerant gas from a low pressure source, typically an evaporator 18 (shown in FIG. 7). The refrigerant gas is compressed by an impeller 36 before being delivered to a volute 38. Lubrication is provided to lubricate shaft seal 39, main journal and thrust bearing 42, thrust collar 44, double bellows shaft seal 46, low speed gear rear bearing 48, pinion gear shaft bearing 50, thrust collar bearing 52 and low speed gear 54. Lubricant and refrigerant are in contact with one another as a small amount of refrigerant gas as it is pressurized invariably leaks from impeller 36 into the various lubricated components described above. After lubricating the compressor components, the lubricant/refrigerant mixture drains by gravity through conduit 56 into sump 11. While settling in oil sump 11 before being re-circulated, refrigerant gas is released from the mixture in excess of the steady-state solubility, dependent upon the pressure and temperature conditions in the sump. Although the exact amount of refrigerant that may collect in sump 11 at any one instant of time is difficult to measure, it is estimated that the flow of refrigerant that is absorbed by the oil and which should be separated in sump 11 is about 1-3% of the total flow of the compressor. To avoid an undesired oil viscosity as the oil cools once the compressor is stopped, an oil heater 57 is provided, heating or maintaining the lubricant within a predetermined temperature range so that it has the proper viscosity as soon as compressor 23 starts. Fluid is pumped from sump 11 by submersible pump 60 and sent to oil cooler 62, which is activated only when the oil is above its predetermined operating temperature. The refrigerant gas that is separated from the oil in the sump is sent to compressor inlet 34 through a vent line 102 (see FIG. 9), while oil, which still may include miscible refrigerant gas, is sent to oil reserve 32 wherein it is metered to the compressor for lubrication purposes, and the lubrication cycle repeats.

Water chillers and heat pumps using centrifugal compressors normally use synthetic refrigerant fluids derived from hydrocarbons. Because of environmental concerns, several families of synthetic refrigerants have been or are being used or are under development, belonging to the families of CFC's, HCFC's, HFC's or HFO's. Most centrifugal chillers in operation today are using HFC-134a. For the higher temperature range of heat pump applications, the tendency is to use lower pressure fluids like HFC-245fa. These HFC's are likely to be replaced to a certain extent by future generation hydrofluoro-olefins (HFO's). Alternately, heat pump applications can be configured to use Low Global Warming Potential Alternative Refrigerants Evaluation Program (Low-GWP AREP) refrigerants (low GWP).

In heat pump systems in which the evaporation pressure and temperature tend to be substantially higher than in water chillers, the oil temperature also should to be set to a higher value in order to keep the oil dilution at an acceptable value. As a result of this higher temperature, the oil viscosity will be reduced if the same grade oil is used as in water chiller systems. An oil grade with higher viscosity can be used to compensate for the higher temperatures experienced in heat pump systems. But even with this compensation for the viscosity, the temperature elevation in such heat pump systems raises other issues. Among these is a risk of failure of the shaft seals and bearings if the oil temperature should become too high. The present invention provides a system that compensates for some of the differences between operation of standard chillers and higher temperature heat pumps due to the temperature difference. This invention should extend the range of application of current standard compressor systems used in chiller applications to heat pump applications, with minor, inexpensive modifications.

Figure 9:
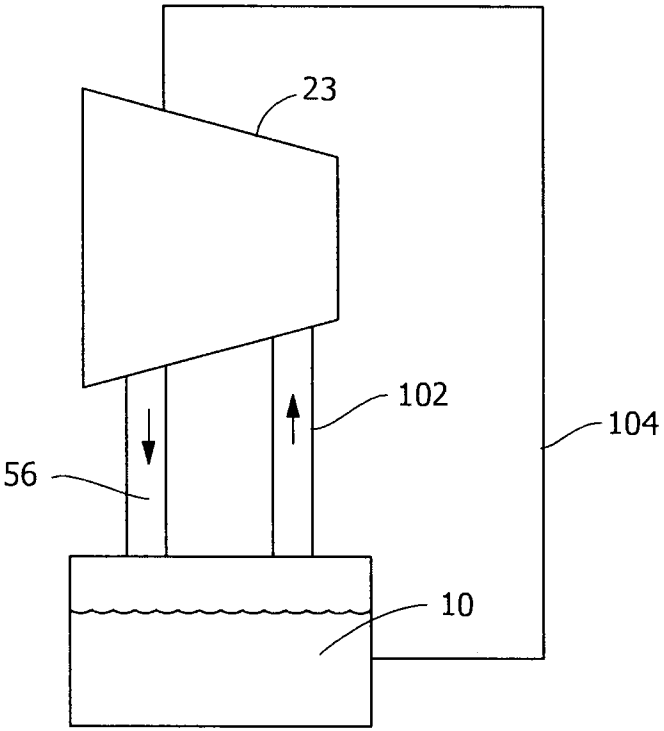
FIG. 9 Prior Art
FIG. 9 is a simplified schematic of a prior art compressor lubrication circuit.

FIG. 9 is a simplified version of the cross sectional representation of prior art FIG. 8 which shows a simplified lubrication cycle schematic, with lubricant and miscible refrigerant being drained from compressor 23 through conduit 56 to sump 11, and then refrigerant gas at sump pressure returned to the compressor inlet along gas conduit 102, while lubricant with miscible refrigerant is returned to compressor 23 along conduit 104.

Although FIGS. 9 through 13 are simplified schematics that depict the prior art and the improvement provided by the present invention, the features required for operation of lubrication circuit depicted in FIG. 8 are also present in the circuits represented in FIGS. 10-13, although with the addition of pressure reducer 409, as set forth herein.

Figure 10:
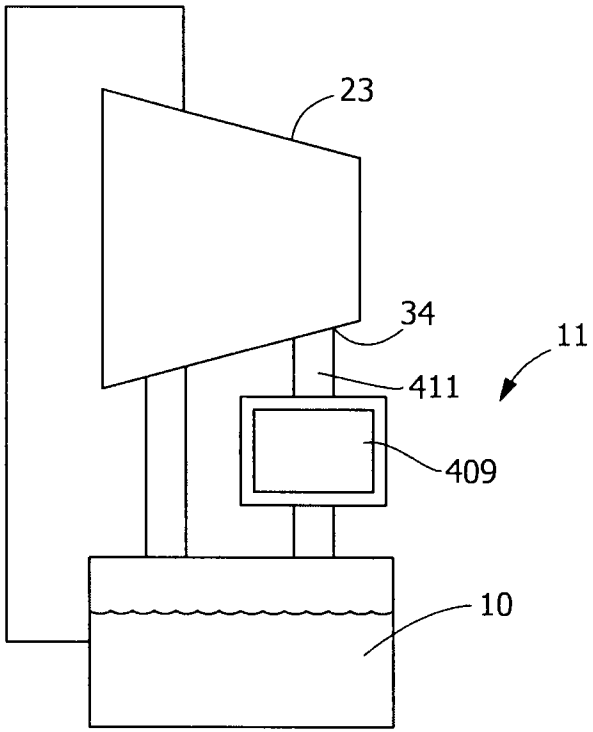
FIG. 10 is a simplified schematic of the compressor lubrication circuit of the present invention.

FIG. 10 provides a simplified version of the present invention, again using a simplified schematic. In FIG. 10, a pressure reducer 409 is positioned between sump 11 and compressor inlet 34 as part of a compressor lubrication system 11 to draw refrigerant gas from the sump while reducing the pressure of refrigerant gas in the sump. Although pressure reducer 409 is shown as connected to the inlet of compressor 34 through connection 411, it is not so restricted, and, as will be recognized by one of skill in the art, pressure reducer 409 can be connected to any low pressure point of the refrigeration circuit. Most often this low pressure point is the evaporator 18 or any connection between the evaporator 18 or an evaporator inlet and compressor inlet 34, including compressor inlet 34. Pressure reducer 409 enables lowering of the pressure (and temperature) of the refrigerant gas in the oil sump. As previously set forth, the lowering of the pressure of refrigerant gas in oil sump 11 has the effect of reducing the dilution of refrigerant in the oil, thereby mitigating the reduction of oil viscosity while providing lubrication of shaft seals and bearings. Lowering the pressure in the oil sump initiates a "virtuous cycle" combining several combined benefits, one of which is the ability of refrigeration system 21 to operate at higher evaporation temperatures and pressures such as encountered in heat pump conditions. When operating at such heat pump conditions, the target for pressure reduction is to set the oil sump gas pressure at a value consistent with the validated range of the same compressor when operating as a water chiller. Thus, if a given type of compressor is validated, for example, for an evaporation temperature of 20° C. (68° F.) with a given refrigerant, the target will be to set the sump pressure corresponding to a 20° C. saturation temperature in heat pump operation, in order to set all the lubrication parameters at the standard value as for chillers. Of course, this is not enough to guarantee that the machine will be reliable. While this course of action will not solve all of the problems in converting a standard compressor for use in high temperature heat pump applications, as other parameters such as design pressure, shaft power, bearing loads etc. must be validated, problems associated with lubrication should be solved. Although all of the detail of the system as shown in FIG. 8 is not shown in the simplified version of FIG. 10, it will be understood that all of the detail of the system shown in FIG. 8 also may be in the simplified system of FIG. 10, except that pressure reducer 409 is included between sump and a low pressure point of the refrigeration system 21.

In addition to providing lubrication to compressors, in an alternate embodiment, the lubrication system could also be used to provide lubrication for steam turbine components.

Figure 11:
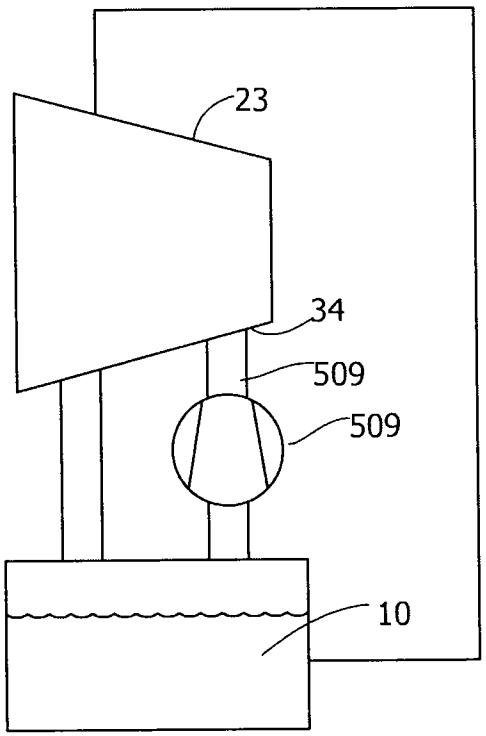
FIG. 11 a simplified schematic of an embodiment of the compressor lubrication circuit of the present invention utilizing an auxiliary compressor.

The pressure reduction in the oil sump can be achieved in different ways. FIG. 11 depicts a simplified version of an embodiment of the present invention, again using a simplified schematic. Although all of the detail of the system as shown in FIG. 8 is not shown in the simplified version of FIG. 11, it will be understood that all of the detail of the system shown in FIG. 8 also may be in the simplified system of FIG. 11, except that a pressure reducer 509 is included between sump and a low pressure point of the refrigeration system 21. In FIG. 11, the pressure reducer is a small additional "auxiliary" compressor 509 positioned between sump 11 and the compressor inlet to draw refrigerant gas from sump 11 while reducing the pressure of refrigerant gas in the sump. Auxiliary compressor 509 has its suction side connected to the gas volume of oil sump 11 and its discharge side connected, for example, to the compressor inlet of main compressor 23. In this implementation, the capacity of auxiliary compressor 509 is controlled in such a way that it keeps the pressure in oil sump 11 at a pre-selected value as described above (e.g. corresponding to the saturated pressure of the refrigerant fluid at 20° C. in the above example). As discussed above and recognized by those skilled in the art, the discharge of the auxiliary compressor 509 can also be connected to any lower pressure point in refrigeration system 21, such as evaporator 18 as shown in FIG. 7.

Figure 12:
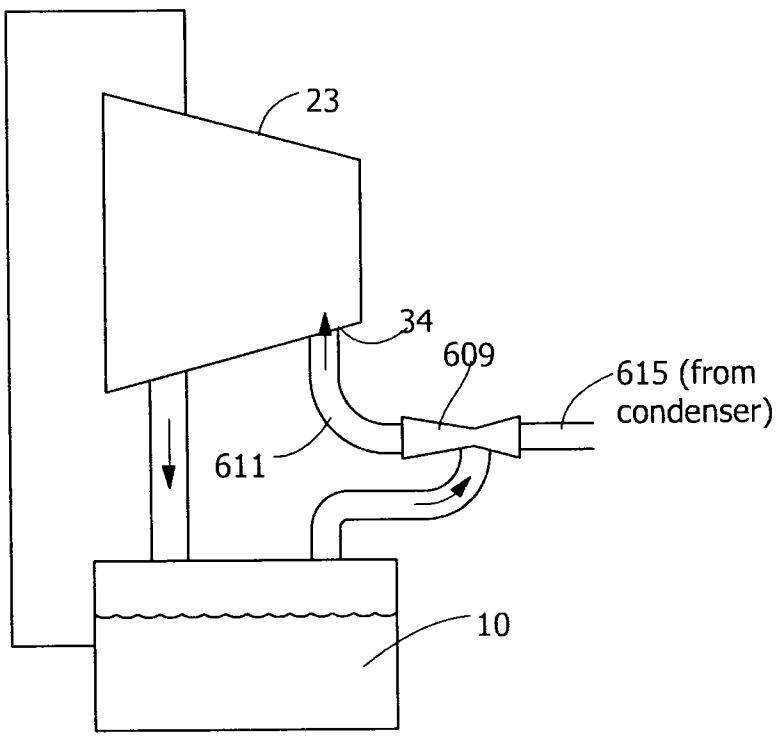
FIG. 12 is a simplified schematic of an embodiment of the compressor lubrication circuit of the present invention utilizing an ejector pump.

In another embodiment depicted in FIG. 12, a simplified schematic of an embodiment of the present invention, an ejector pump 609, also referred to as a jet pump, is depicted as the pressure reducer associated with sump 11. Again, all of the detail of the system as shown in FIG. 8 is not shown in the simplified version of FIG. 12, and it will be understood that all of the detail of the system shown in FIG. 8 also may be in the simplified system of FIG. 12, except that ejector pump 609 is positioned between sump and a low pressure point of the refrigeration system. In FIG. 12, high pressure gas from conduit 615, which is in fluid communication with condenser 25, after passing through an expansion valve, if required, is used to provide the energy to operate ejector pump 609. At the ejector outlet, the mixture of this high pressure fluid from condenser 25 and the low pressure gas pumped from oil sump 11 is sent to a low pressure point in the refrigeration system, preferably the evaporator. Although shown in FIG. 12 as in direct fluid communication with compressor inlet 34 via conduit 611 (for consistency with FIGS. 10 and 11), the low pressure point may be at any intermediate location between compressor 23 and the evaporator that is at a low pressure. The advantage of this embodiment, using a jet pump, is that it avoids moving parts such as found with the use of the auxiliary compressor of FIG. 5. This embodiment does suffer from a drawback, because ejector pumps usually have a relatively poor efficiency, and thus penalize the energy efficiency of the refrigeration system. Nevertheless, the use of ejector pump 609 in refrigeration system 21 is a viable option to reduce refrigerant in sump 11, while allowing the lubrication system to operate with higher temperature systems seen in heat pump applications.

Figure 13:
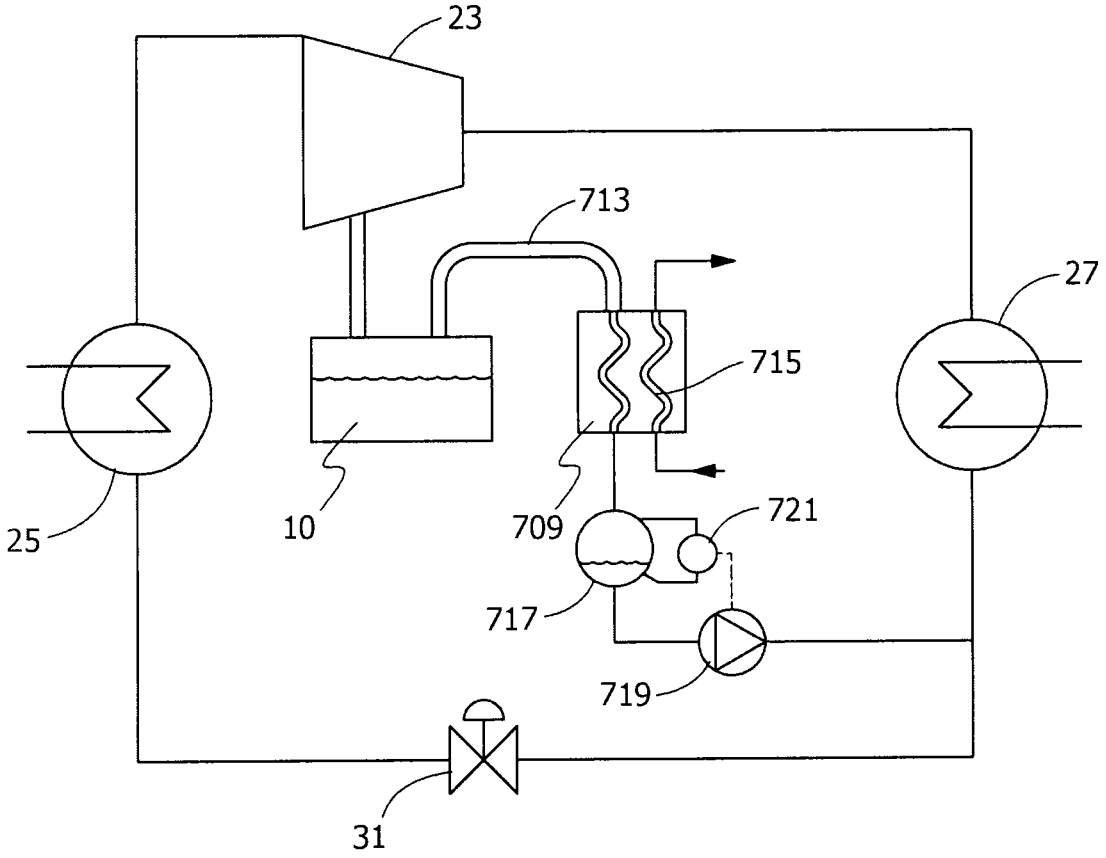
FIG. 13 is a simplified schematic of an embodiment of the compressor lubrication circuit of the present invention utilizing an auxiliary condenser and liquid pump.

In a preferred embodiment of the present invention depicted in FIG. 13, a simplified schematic of an embodiment of the present invention, an auxiliary condenser 709 is depicted as the pressure reducer associated with sump 11. Again, all of the detail of the system as shown in FIG. 8 is not shown in the simplified version of FIG. 13, and it will be understood that all of the detail of the system shown in FIG. 8 also may be in the simplified system of FIG. 13, except that auxiliary condenser 709 is included between sump 11 and a low pressure point of the refrigeration system. In FIG. 13, refrigerant gas from sump 11 is in fluid communication with auxiliary condenser 709 via conduit 713. Gas from sump 11 enters auxiliary condenser 709 where it is in heat exchange relationship with a cooling fluid flowing through cooling circuit 715. Cooling fluid in cooling circuit 715, such as water or air or other suitable fluid cools the refrigerant gas, condensing it from a gas to a liquid that is sent to liquid storage space 717.

The auxiliary condenser 709 is selected to provide a condensing pressure equal to the desired refrigerant pressure in oil sump 11. This requires the refrigerant gas in auxiliary condenser 709 to be cooled by a cooling fluid at a temperature lower than the cold source of the heat pump. For example, if the desired condensing pressure in the auxiliary condenser 709 corresponds to a 20° C. (68° F.) saturation temperature, auxiliary condenser 709 preferably is cooled with water having an entering temperature of about 12° C. (about 54° F.) and a leaving temperature of about 18° C. (about 64° F.). The cooling water may be provided from any available chilled water source as well as from ground water within the desired temperature range. The condensing pressure may be controlled by varying the flow and/or temperature of the cooling fluid through cooling circuit 715 of auxiliary condenser 709 to maintain the desired gas pressure in oil sump 11. As depicted in FIG. 13, liquid storage space 717 for condensed refrigerant may be a separate vessel as shown, or may be a separate storage space integral to auxiliary condenser 709.

Per the principle of the system, liquid storage space 717 is at a lower pressure than the compressor and the evaporator in the main refrigerant circuit. To avoid accumulation of liquid refrigerant in liquid storage space 717, refrigerant must be pumped from storage space 717 back to refrigerant system 21 by pump 719 that is controlled by liquid level sensor 721. This pump 719 has its suction side connected to fluid storage space 717 and its discharge side in communication with refrigerant system 21. To reduce the head and the absorbed power of the pump, it is preferred to set the pump discharge in a low pressure portion of the main refrigerant circuit 21. While this low pressure region may be the compressor inlet, as previously discussed with regard to FIGS. 9-12, FIG. 13 depicts the low pressure region as the conduit between expansion valve 31, evaporator 18, although refrigerant may be sent to the low pressure region at any convenient point, such as between expansion valve 31 and compressor suction 34. It is also normally desired to avoid sending refrigerant liquid directly into compressor suction 34 (inlet), to avoid liquid flooding of compressor 23. Therefore, a location along the conduit between expansion valve 31 and evaporator 18 is a desirable input, as is supplying this liquid refrigerant to evaporator 18, such as at the liquid inlet of evaporator 18. More specifically, if evaporator 18 is of the dry-expansion technology (either shell and tube or plate heat exchanger), then it is desirable to discharge the liquid refrigerant into the main liquid line at the evaporator inlet. If evaporator 18 is of the flooded type, falling film or hybrid falling film, an alternative is to discharge the liquid directly in the evaporator shell, at a location away from the suction pipe to avoid liquid carry-over.

Means also is provided to control the operation of liquid pump 719, depicted in FIG. 13 as liquid level sensor 721. A desired arrangement is to have fluid storage space 717 located at the outlet of auxiliary condenser 709, allowing liquid refrigerant to flow by gravity from auxiliary condenser 709 into storage space 717. This volume can either be included in the same shell as the auxiliary condenser 709, or as a separate vessel. The liquid level in this storage space is sensed by a liquid level sensor which includes a control loop, depicted simply as liquid level sensor 721. This control loop portion of liquid level sensor 721 manages the operation of liquid pump 719 in order to keep the liquid level in the fluid storage space 717 within pre-set acceptable limits. Liquid pump 719 can either have a variable speed drive, with the speed being controlled by the control loop of liquid level sensor 721, or it may simply have an ON/OFF operation sequence, also under control of the same control loop.

The control system allows an external source to provide cooling fluid to the auxiliary condenser 709 if lubrication is required in auxiliary condenser 709 and chiller system 10 is operating; or if chiller 18 is in coastdown; or if steam turbine 14 is in a post-cooldown slow roll mode; or if the saturation temperature in oil sump 11 exceeds a threshold temperature.

Refrigerant gas is vented from sump 11 to the compressor suction when the chiller 18 is off. When the chiller is on, the vent valve is energized when the sump temperature is less than a predetermined venting temperature, e.g., a default temperature of 77° F.; or when the leaving chilled water temperature is greater than the venting setpoint, turn on the vent valves when sump pressure is greater than the evaporator pressure by at least a minimum threshold margin, e.g., 3 psi. Once active, the vent valve(s) remains in the on state until the sump pressure drops to less than the evaporator pressure by a predetermined threshold value, e.g., 6 psi.

When chiller 18 is on, the vent valve is energized when the sump temperature is greater than or equal to the predetermined venting temperature, or the sump pressure exceeds the evaporator pressure by the minimum threshold margin, e.g., 3 psi. The vent valves are deenergized when the evaporator temperature is greater than or equal to the sump venting temperature and the sump pressure is less than the evaporator pressure by a predetermined threshold value, e.g., 6 psi. Under power failure conditions, the auxiliary condenser may be vented to the sump 11.

When the chiller 18 does not have sufficient head pressure available to pressurize the storage space 717, the refrigerant in the storage space 717 must be pumped using a refrigerant liquid pump. The pump is activated by a high level indication in the storage space 717. The refrigerant liquid pump continues to run until a low level indication is measured in the storage space 717. The condensate storage space 717 operates on the high and low refrigerant level indicator switches. Alternatively when the chiller is running, a high refrigerant level indication initiates closure of the auxiliary condenser storage space vent valve. After a short delay to account for the closure time of the vent valve, the storage space 717 may be pressurized with condenser gas by opening a pressurization valve which forces the liquid refrigerant out of the storage space 717 via the check valve at the bottom. When the tank indicates an empty condition, the pressurization valve is closed, and the auxiliary condenser collection space drain/vent valves are opened.

Figure 14:
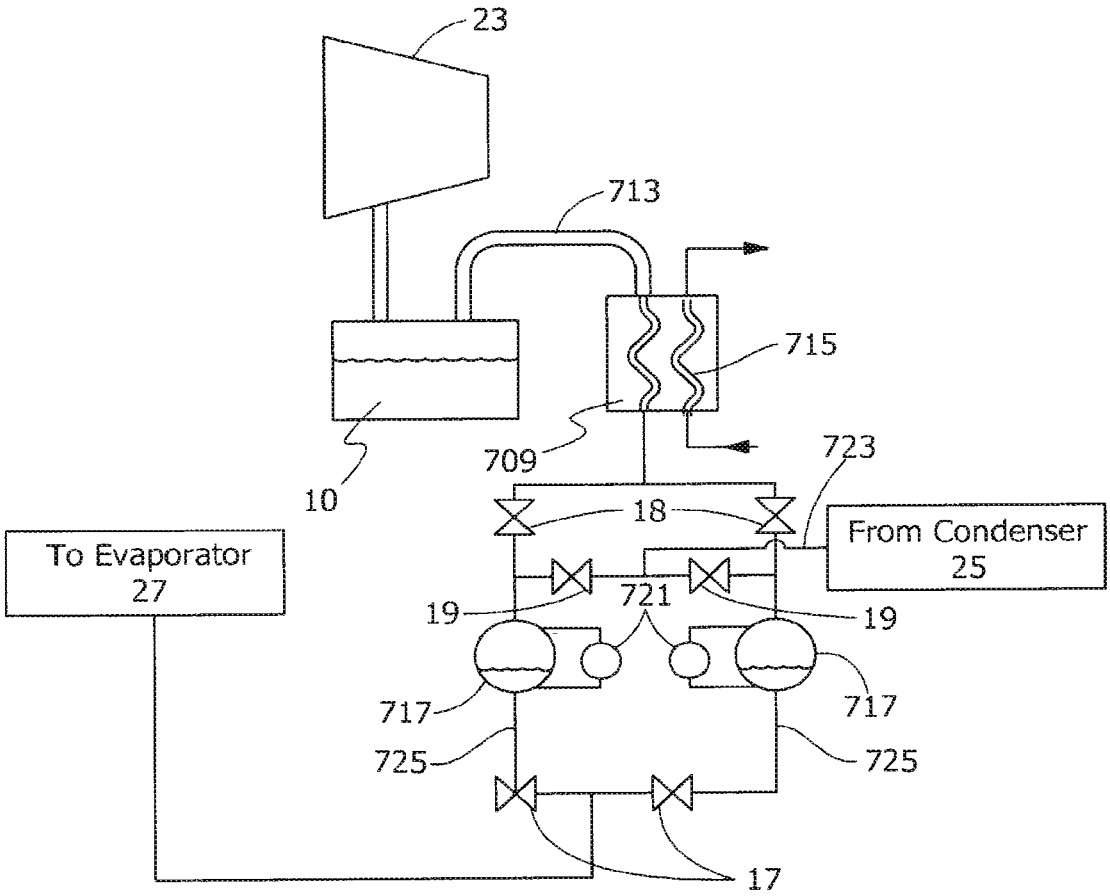
FIG. 14 is a simplified schematic of an embodiment of the compressor lubrication circuit of the present invention utilizing an auxiliary condenser.

In another embodiment, a conventional mechanical pump may be replaced by a purely static pumping system. In a variation to this embodiment, the static pumping system may utilize an ejector pump powered by high pressure gas from main condenser 25. A mixture of pumped liquid from fluid storage space 717 and of high pressure gas from main condenser 25 is returned to evaporator 18. In still another variation to this embodiment, two vessels may be located below auxiliary condenser 715, each having an inlet (A) connected to the discharge port of auxiliary condenser 709 to receive condensed refrigerant liquid, an inlet (B) connected to receive gas from evaporator or main condenser 25, and each having outlet (C) connected to evaporator 18. Each of these connections has an automatic valve that can be opened or closed. The system is operated in "batches", being activated by a control circuit using principles known to those skilled in the art. This system is represented in FIG. 14, as associated with the cooling of a semi-hermetic motor. In yet another embodiment that operates in "batches", where the oil return from the evaporator can yield too much vapor, possibly resulting in insufficient lubrication, a distillation chamber (not shown) also sometimes referred to as a flash tank, which may be operated by electrical heating, can be used. When a flash tank is used, the size of auxiliary condenser 709 can be reduced.

Any of the embodiments enable removal of refrigerant from oil in a lubricated compressor. An auxiliary compressor 509 or ejector pump 609 may advantageously be used to remove refrigerant from oil. An auxiliary condenser 709 has the further advantage of not requiring power to operate, assuming that water at the desired temperature is available. But it requires a liquid pump 719 to transfer condensed liquid to refrigerant system 21 at or near evaporating pressure.

The auxiliary condenser 709 is arranged to reduce the pressure of the oil sump to a value that is below the suction pressure of the compressor 23. Typically compressor suction 34 is the lowest pressure in the system. The combination of appropriate oil sump temperature regulation and sump pressure management via the auxiliary condenser 709 make the dual compressor steam turbine advantageous. The ability to control the oil sump temperature and pressure provides the ability to control the oil quality and refrigerant dilution in the oil. As shown in FIG. 14, two vessels may be located below auxiliary condenser 709, each having an inlet connected to the liquid outlet from auxiliary condenser 709 to receive condensed refrigerant liquid, a high pressure gas inlet 723 connected to receive high pressure gas, from main condenser 25 as shown in FIG. 14, and each having outlet 725 connected to evaporator 18. Condenser 25 is a convenient source for the high pressure gas in FIG. 14, but any other high pressure gas source may be utilized. High pressure gas inlet 723 provides the power to empty the fluid storage vessels or spaces 717, forcing the liquid from the fluid storage vessels 717 into the evaporator. The valves, depicted as valves 17, 18 and 19 in FIG. 14, are actuated to perform the function of alternatively emptying and filling each fluid storage vessel 717. Their operation is straightforward to those skilled in the art, having been used in some ice skating rinks to replace the liquid pump with the two receivers used alternatively: one being filled with the liquid draining from the auxiliary condenser, while the other being emptied by high pressure gas from the condenser. Each of these connections has an automatic valve that can be opened or closed. The system is operated in "batches", being activated by a control circuit using principles known to those skilled in the art. Liquid pump 719 is not required in this arrangement.

Any of the embodiments allow for refrigerant to be used to cool bearings, particularly in systems utilizing magnetic bearings. The use of an auxiliary compressor 509 or ejector pump 609 may advantageously be used, however, these components may require significant power consumption or otherwise penalize system efficiency. An auxiliary condenser 709 has the further advantage of not requiring power to operate, assuming that water at the desired temperature is available for heat exchange. But a system utilizing the auxiliary condenser also requires a liquid pump 719 to transfer condensed liquid to refrigerant system 21 at or near evaporating pressure. Although this does require a small amount of power, it is significantly less than the power required from operation of an auxiliary compressor 509, and there is no penalty to overall system efficiency such as with operation of ejector pump 609.

The basic pressure reducers described above with reference to FIG. 14 effectively remove refrigerant from the cavity of the motor while allowing the refrigerant to remove heat from motor operation as well as magnetic bearings, when the system is so equipped. These pressure reducers can advantageously be utilized in heat pump applications systems which typically operate at higher temperatures than chiller systems. These pressure reducers extend the motor cooling capability of the refrigerant, permitting the use of chiller system equipment for heat pump applications.

Other disclosure is contained in Applicant's pending application, U.S. Provisional Patent Application No. 61/767,402, which is incorporated by reference in its entirety.

Another aspect of this disclosure generally relates to a method and apparatus for sensing rotating motion of the steam turbine shaft or one or both of the compressor shafts. The disclosure relates more specifically to sensing rotating motion of the steam turbine shaft with an eddy current sensor responsive to an insert integrated in the shaft having magnetic properties varying from the shaft material. Other disclosure is contained in Applicant's U.S. Nonprovisional patent application Ser. No. 11/876,205, which is incorporated by reference in its entirety.

Figure 15:
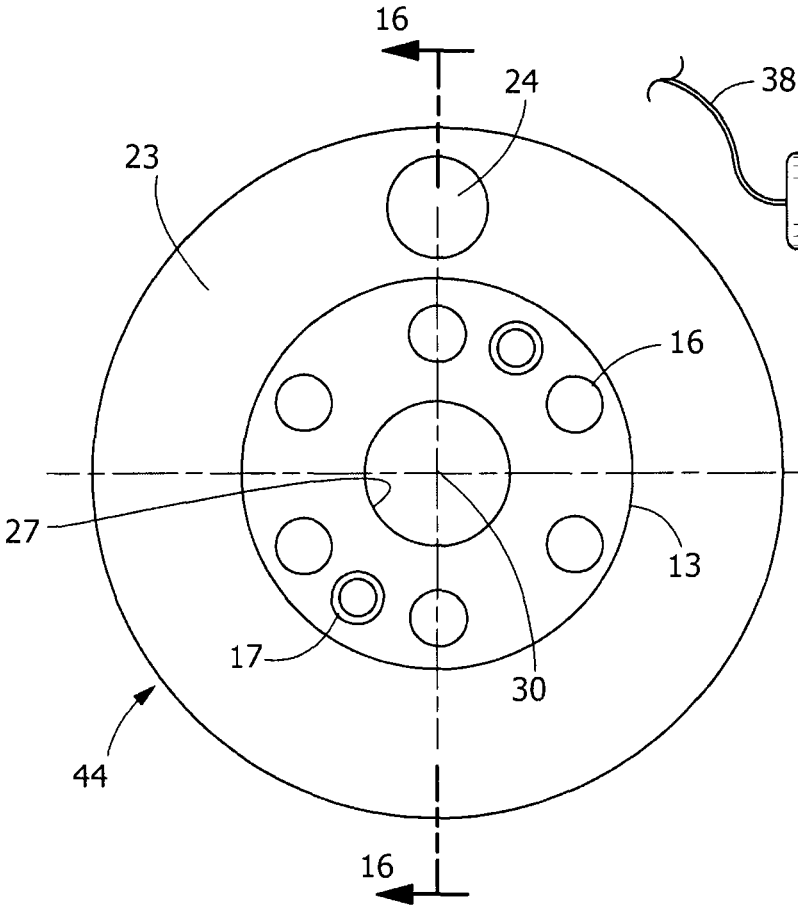
FIG. 15 is an elevational view of an exemplary thrust collar.
Figure 16:
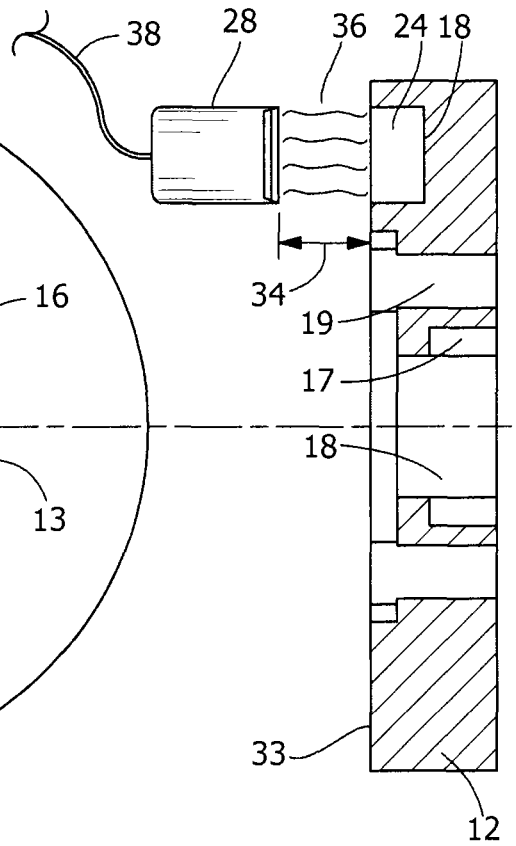
FIG. 16 is a sectional view taken along the lines 2-2 in FIG. 15.

In FIGS. 15 and 16, the disclosed embodiment includes a novel application of an eddy-current proximity probe that senses a difference in magnetic properties of a rotating surface, and is used to detect and measure motion of the steam turbine shaft. Referring to FIGS. 15 and 16, the disclosed embodiment includes a novel application of an eddy-current proximity probe that senses a difference in magnetic properties of a rotating surface, and is used to detect and measure motion of the compressor shaft. A substantially smooth rotating device 10, e.g., a thrust bearing or a seal, includes a thrust collar surface 23 and a counterbore surface 13. Loading screws 16 are inserted through screw holes 19 drilled through the counterbore surface 13, for threaded attachment to another rotating device, such as a rotor or a fan blade (not shown) attached to a drive shaft 27. The counterbore surface 13 also includes a pair of internally threaded holes 17 for pulling the rotating device from a drive shaft 27. Drive shaft 27 is rotatably fixed to the thrust collar 44 by a keyway and key 17.

The thrust collar surface 23 includes a counter bored recess 26 that is dimensioned to receive an insert plug or target element 24. The shape of counter bored recess 26 is shown in a substantially rectangular cross section, although various cross-sectional shapes may be used, e.g., having rounded, partially-rounded, or tapered bottom surfaces, corresponding to the tools used to drill or bore the recess 26. The insert plug 24 is formed from a material having substantially different magnetic properties, e.g., conductivity or permeability, from the magnetic properties of the outer collar ring material. In one embodiment, the thrust collar surface 23 may be constructed of carbon steel 4340, and the insert plug constructed of stainless steel 414. Stainless steel possesses different magnetic properties from those of the parent material in the thrust collar surface 23.

In the above embodiment, the insert plug 24 is capable of performing the mechanical function of the carbon steel thrust collar surface 23. Insert plug 24 is inserted into counter bored recess 26 in the surface of thrust collar surface 23 with an interference fit. Surface 33 of the shaft 27 and thrust collar 44 is then machined smooth such that the insert plug 24 is flush with and has the same surface finish as the surface of outer collar ring 23.

A magnetic sensor or pickup 28 is positioned opposing and generally coaxially with the insert plug 24. Insert plug 24 and sensor 28 are axially offset from rotary axis 30 of coaxially arranged shaft 27 and thrust collar 44. In the example thrust collar 44, insert plug 24 is positioned outside the perimeter of the inner ring, although insert plug 24 and counter bored recess 26 may be located anywhere along the radius that is not substantially coaxial with shaft 27 and thrust collar 44.

Insert plug 24 passes adjacent to magnetic sensor 28 once per shaft rotation, although in alternate embodiments, more than one insert plug may be positioned at predetermined intervals if a higher frequency magnetic impulse is desired. A change in the magnetic field is caused by the target material of insert plug 24 having differing magnetic properties from the material of thrust collar 44, as insert plug 24 passes the sensor during rotation. An impulse is created in the sensor output signal due to the different magnetic properties of the two metals causing perturbations in magnetic field 36 associated with each of the target and outer collar ring materials, as they rotate adjacent to sensor 28. Sensor 28 is connected via cable or other transmission medium (e.g., wireless transmitter) to a controller (not shown) for processing the impulse signal. The processed signal may be used, e.g., for providing a feedback control loop for controlling the speed of a rotating motor or engine; for a speedometer display; or to detect an overspeed condition.

Figure 17:
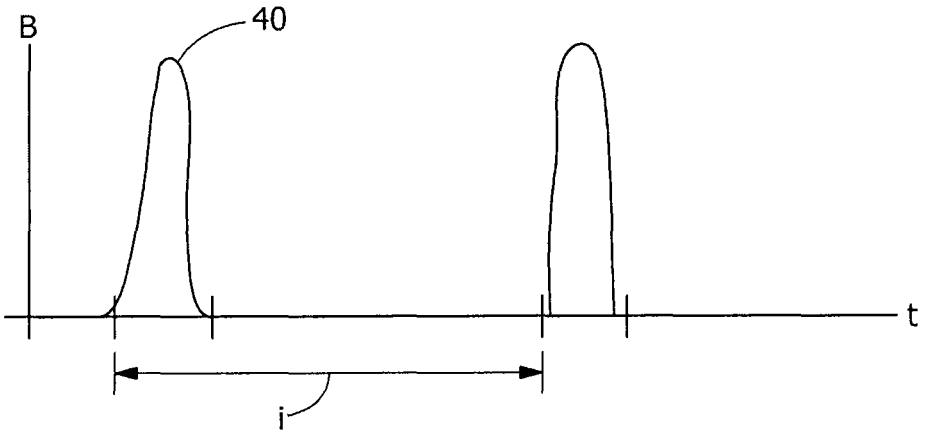
FIG. 17 is a graph showing a periodic magnetic impulse versus time.

Referring to FIG. 17, pulses 40 are illustrated along a time function graph corresponding to the passage of insert plug 24 by magnetic sensor 28. Impulse 40 appears at time intervals i that vary inversely proportionally to the rotational velocity of shaft 27. The impulse spacing can thus be used to detect and measure whether shaft 27 is rotating, and to determine the rotational velocity of shaft 27. Further, impulse 40 may be used as a phase reference for various purposes, such as for rotating machinery vibration diagnostics, when employed in conjunction with additional vibration sensors. With the above-described embodiment, a useful signal output is generated without introducing physical abnormalities or dimensional discontinuities in surface 33, which provides the advantageous ability to locate the insert plug 24 within a bearing or collar 44.

Figure 18:
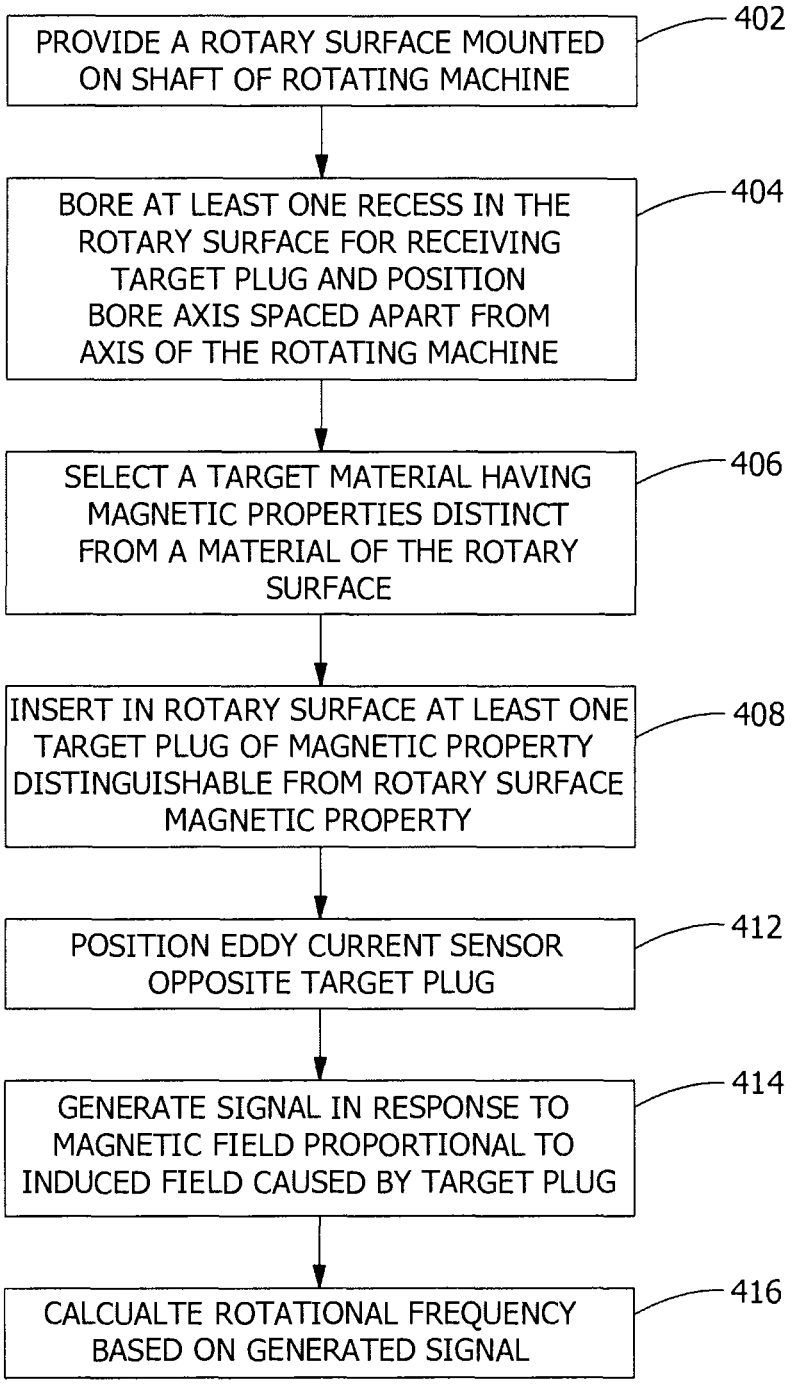
FIG. 18 is a method flow diagram.

Referring next to FIG. 18, there is a diagram showing one embodiment of a method for measuring rotational frequency of a rotating machine. The method includes providing a rotary surface along the steam turbine shaft of the rotating machine (step 402). Next, at least one recess is bored in the rotary surface at to receive a target element, such that the inserted target element axis is spaced at a distance from a rotational axis of the rotating machine and parallel thereto (step 404). A target material is then selected for the target element having magnetic properties distinct from the material from which the rotary surface is constructed (step 406). The target element is inserted in the rotary surface (step 408). The magnetic sensor is positioned opposite the target element or elements (step 412). The magnetic sensor is configured to generate a signal responsive to and proportional to a magnetic field induced by the magnetic properties of the rotary surface and the target element, respectively (step 414). As the machine rotates, the magnetic generates a signal indicative of the magnetic field sensed by the sensor. Next, the system calculates the rotational frequency based on generated signal (step 416). In one embodiment, the method may further include finishing the surface of the rotary element and the surface of the target element to a flush, polished microfinish surface.

Figure 19:
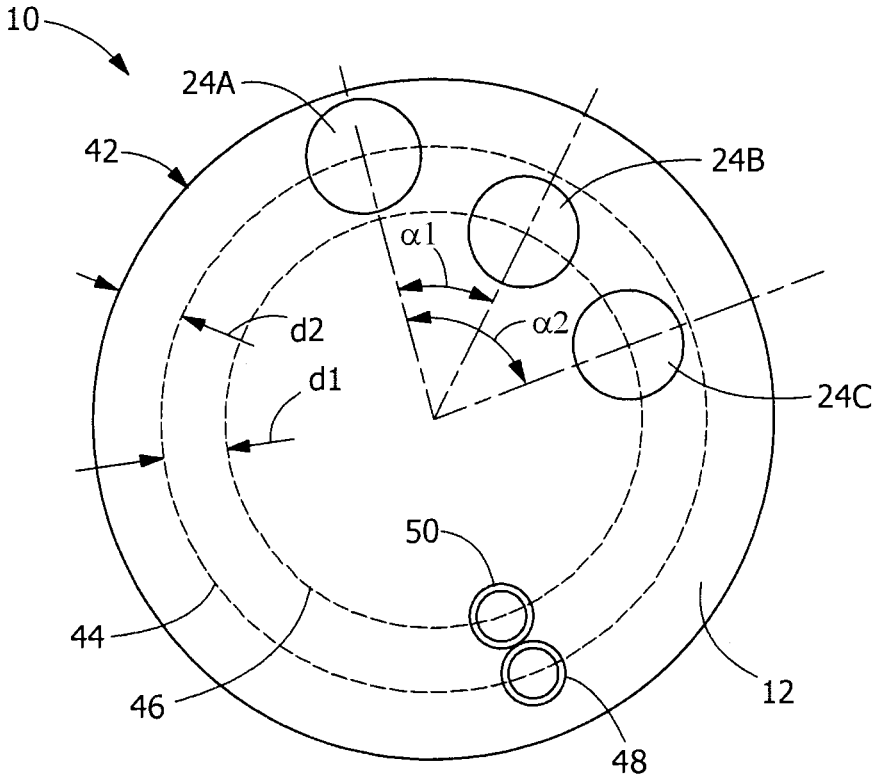
FIG. 19 is a schematic diagram of the invention with two magnetic sensors and multiple targets arranged on a rotating surface at different radii.
Figure 20A:
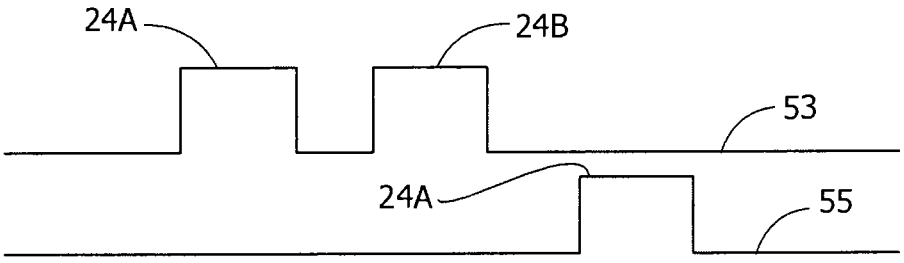
FIG. 20A is a probe output waveform corresponding to the target arrangement of FIG. 19, when the surface is rotating in a clockwise direction.
Figure 20B:
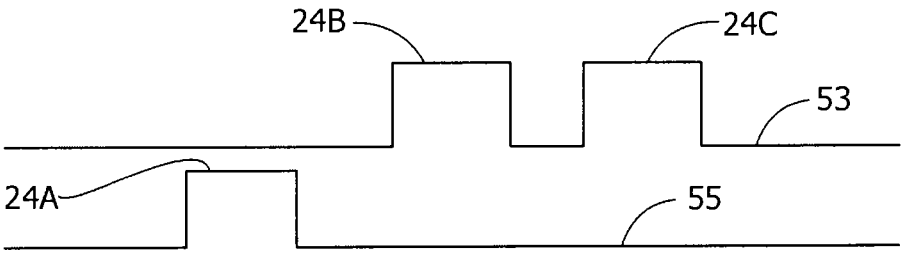
FIG. 20B is a probe output waveform corresponding to the target arrangement of FIG. 19, when the surface is rotating in a counterclockwise direction.

FIG. 19 shows multiple insert plugs arranged on a rotating device 10 for detecting the direction of rotation of rotating device 10, as well as the rotational velocity. A first insert plug 24*a* is located in thrust collar surface 23 at a predetermined radial distance d2 from outer edge 42 which follows first rotational path 45 when device 10 is rotating. A second insert plug 24*b* and a third insert plug 24*c* are located in thrust collar surface 23 at a predetermined radial distance d1 from the first rotational path 45, and follow a second rotational path 46 when device 10 is rotating. First insert plug 24*a* is located at a position that is offset radially from the positional angles of insert plugs 24*b*, 24*c*, indicated by $\alpha 1$ and $\alpha 2$. Stationary probe positions 48, 50 correspond to points along each of the first and second paths 44, 46, respectively. Insert plug 24*a* passes adjacent first sensor probe 28 at location 48 once per revolution; and each of insert plugs 24*b* and 24*c* pass adjacent second sensor probe 28 at location 50 once per revolution. The magnetic properties of the insert plugs 24*a*, 24*b*, 24*c* cause the sensor probes 28 at locations 48, 50 to generate pulses corresponding to the time that the respective insert plugs 24*a*, 24*b* and 24*c* pass proximate to sensor probes 28 at locations 48 and 50, respectively. The resulting waveforms of the sensor output signals is shown in FIGS. 20A and 20B. For a clockwise rotation as shown in FIG. 20A, waveform 53 includes two square waves or pulses corresponding to probe 28 at location 50 and waveform 54 includes a single square wave or pulse lagging the pulses of waveform 53 corresponding to probe 28 at location 48. The asymmetrical arrangement of insert plugs 24*a*, 24*b* and 24*c*, provides a long interval before the wave sequences repeat, which indicates which pulse or pair of pulses is appearing first in the sequence. Referring to FIG. 20B, the rotation of device 10 is counterclockwise, so pulse waveform 54 leads pulse waveform 53. In an alternate embodiment for sensing rotational direction insert plugs 24*a* and 24*b* and probe 48 may lie in the same path at a radial distance d1 from edge 24. Insert plugs 24*a* and 24*b* may be made of magnetically distinct materials, such that each plug 24*a*, 24*b* generates a substantially different output from the probe 48 as the plugs 24*a* and 24*b* pass by the probe 48 in sequence. Pulses induced in the sensor output waveform 55, will differ in magnitude, thereby indicating which plug 24*a*, 24*b*, passes the sensor position 49 first, and the direction in which the device 10 is rotating. In yet another embodiment, insert plugs 24*a* and 24*b* may be made of similar magnetic material and have different diameters, creating a responsive waveform having an identifiable longer or shorter pulse, respectively. It will be appreciated by those skilled in the art to modify the arrangement of the insert plugs in various other ways to achieve the same results for determining rotational direction.

Figure 21:
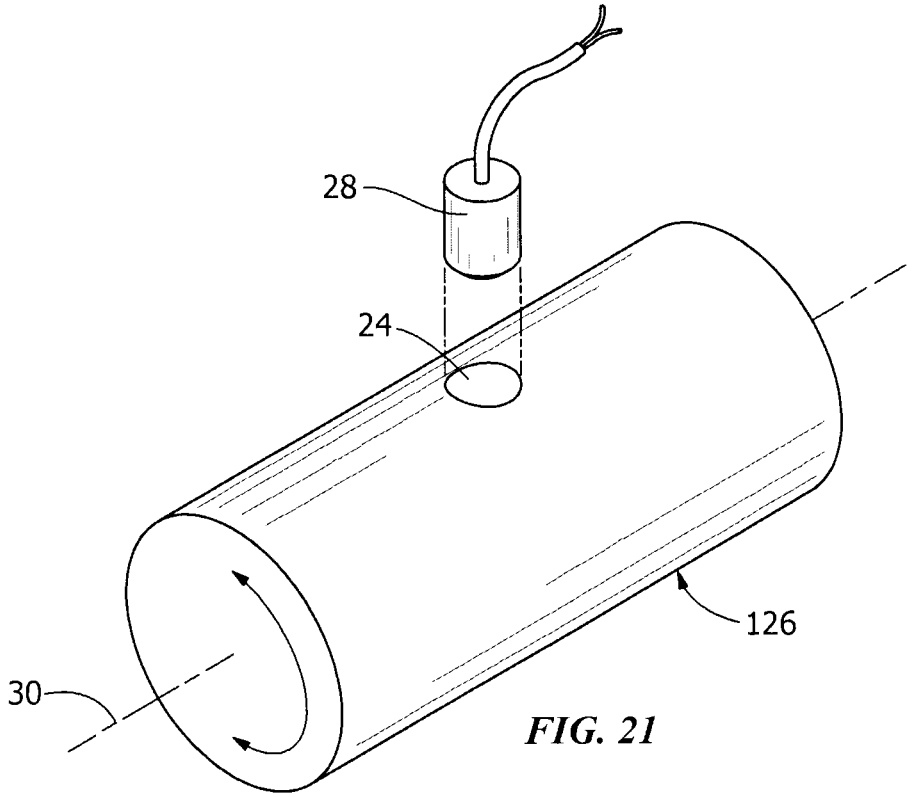
FIG. 21 is an alternate embodiment of the invention with the target inserted in a rotating shaft.

FIG. 21 is an embodiment of the invention with the target 24 inserted directly into a rotating shaft 30. The target 24 is machined flush with the rotating surface of the shaft 27. In this embodiment, the sensor 28 is directed at the target 24 and is aligned substantially perpendicular to the axis 30 of the shaft rotation. The embodiment of FIG. 25 may be employed, e.g., where no thrust collar or bearing is attached to the steam turbine shaft, or where there is insufficient space at the distal end of the shaft 30 for placement of an axially aligned sensor 126. As described in the embodiments discussed in FIGS. 15 through 25B, the target is placed into a counter bored recess (not shown) of the shaft, and then machined and polished to a flush, microfinished surface, with an interference fit.

In one embodiment, the control system may include a quick disconnect coupling to each compressor to that each compressor can be disengaged from the steam turbine if the respective compressor experiences a fault on an indication of high or low oil pressure, high or low oil temperature, or a thrust fault, while the chiller system is operating or if the steam turbine is in a post-cooldown slow roll mode. The control system will wait for the driveline speed to be less than the minimum rated speed to avoid overspeed, and then engage the disconnect coupling by engaging the output for 10 seconds. A coupling reset switch or button must then be activated to clear this trip, so that the quick disconnect coupling may be manually reset. By disconnecting the compressor the turbine can then slow roll coastdown without turning the compressor driveshaft.

The combination of a steam driven turbine, single shaft machine for powering two compressors requires that the compressors operate in parallel and share the load. In sharing the load, the load must be balanced as closely as possible in order to maintain stable operation of both compressors. Each compressor is provided with a separate control panel and electronics. When a surge condition is detected in one compressor, the controller responds by changing the speed of the steam turbine 14. Either compressor 12, 12*a*, may be operated as a lead compressor for the control system. The remaining compressor, or lag compressor, will follow the capacity, surge or stability control to the setpoints determined by the lead compressor controls.

Figure 22:
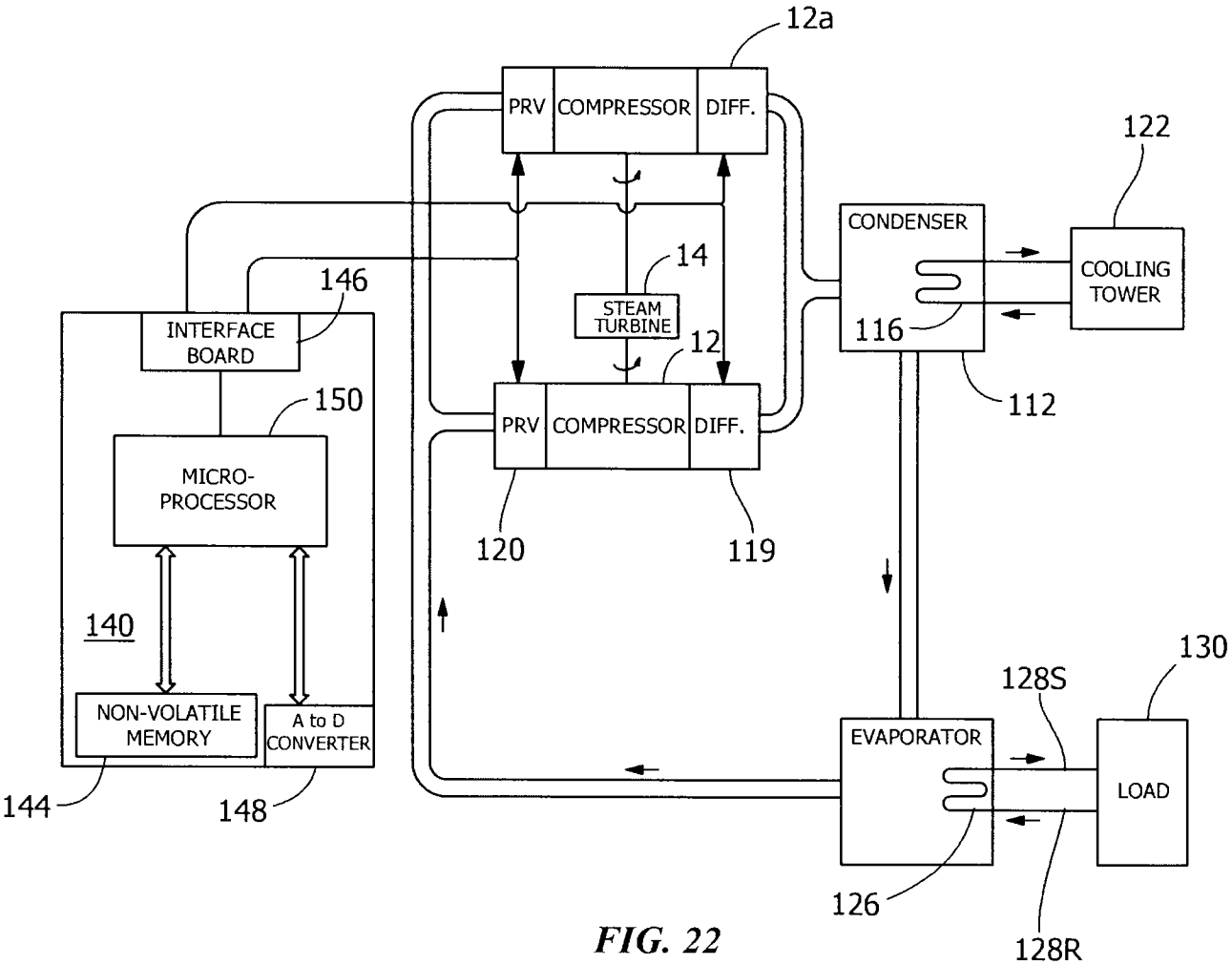
FIG. 22 is a schematic diagram of an exemplary HVAC system.

Referring to FIG. 22, at the input or inlet to each compressor 12, 12*a* from the evaporator 126, there are one or more PRV or inlet guide vanes 120 that control the flow of refrigerant to the compressor 108. An actuator is used to open the PRV 120 to increase the amount of refrigerant to the compressor 108 and thereby increase the cooling capacity of the system 100. Similarly, the actuator is used to close the PRV 120 to decrease the amount of refrigerant to the compressor 108 and thereby decrease the cooling capacity of the system 100. A variable geometry diffuser (VGD) 119 is used as a method to control surge and stall in the compressors 12, 12*a*.

Figure 23:
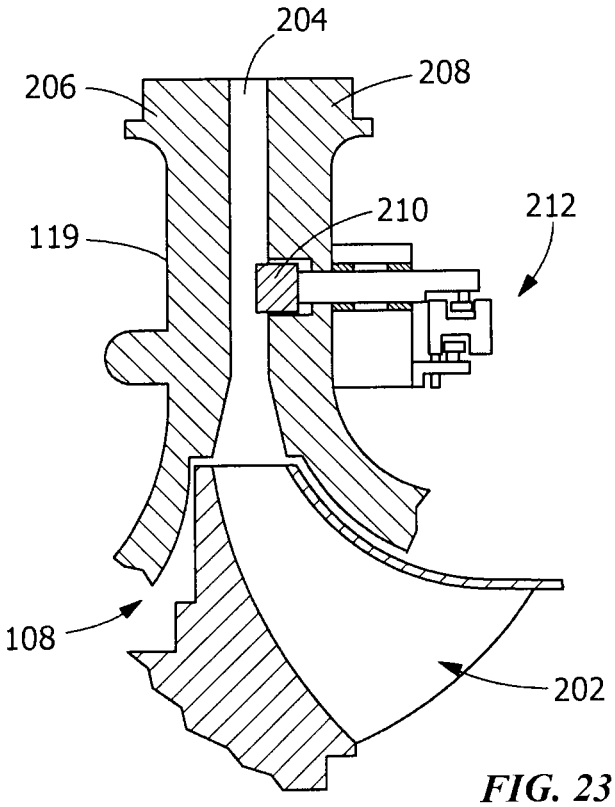
FIG. 23 illustrates a partial sectional view of the compressor 108 of a preferred embodiment of the present invention

FIG. 23 illustrates a partial sectional view of the compressor 108 of a preferred embodiment of the present invention. The compressor 108 includes an impeller 202 for compressing the refrigerant vapor. The compressed vapor then passes through a VGD 119. The VGD 119 is preferably a diffuser having a variable geometry, e.g., a vaneless radial diffuser or other suitable diffuser type. The VGD 119 has a diffuser space 204 formed between a diffuser plate 206 and a nozzle base plate 208 for the passage of the refrigerant vapor. The nozzle base plate 208 is configured for use with a diffuser ring 210. The diffuser ring 210 is used to control the velocity of refrigerant vapor that passes through the diffuser space or passage 202. The diffuser ring 210 can be extended into the diffuser passage 202 to increase the velocity of the vapor flowing through the passage and can be retracted from the diffuser passage 202 to decrease the velocity of the vapor flowing through the passage. The diffuser ring 210 can be extended and retracted using an adjustment mechanism 212 driven by an electric motor to provide the variable geometry of the VGD 119. A more detailed description of the operation and components of one type of variable geometry diffuser 119 is provided in U.S. Pat. No. 6,872,050, issued Mar. 29, 2005, which patent is hereby incorporated by reference. However, it is to be understood that any suitable VGD 119 can be used with the present invention.

The control panel 140 has an A/D converter 148 to preferably receive input signals from the system 100 that indicate the performance of the system 100. For example, the input signals received by the control panel 140 can include the position of the PRV 120, the temperature of the leaving chilled liquid temperature from the evaporator 126, pressures of the evaporator 126 and condenser 112, and an acoustic or sound pressure measurement in the compressor discharge passage. The control panel 140 also has an interface board 146 to transmit signals to components of the system 100 to control the operation of the system 100. For example, the control panel 140 can transmit signals to control the position of the PRV 120, to control the position of an optional HGV, if present, and to control the position of the diffuser ring 210 in the variable geometry diffuser 119. The control panel 140 may also include many other features and components not shown in the figures. These features and components have been purposely omitted to simplify the control panel 140 for ease of illustration.

The control panel 140 uses a control algorithm(s) to control operation of the system 100 and to determine when to extend and retract the diffuser ring 210 in the variable geometry diffuser 119 in response to particular compressor conditions in order to maintain system and compressor stability. Additionally, the control panel 140 can use the control algorithm(s) to open and close the optional, HGV, if present, in response to particular compressor conditions in order to maintain system and compressor stability. In one embodiment, the control algorithm(s) can be computer programs stored in non-volatile memory 144 having a series of instructions executable by the microprocessor 150. While it is preferred that the control algorithm be embodied in a computer program(s) and executed by the microprocessor 150, it is to be understood that the control algorithm may be implemented and executed using digital and/or analog hardware by those skilled in the art. If hardware is used to execute the control algorithm, the corresponding configuration of the control panel 140 can be changed to incorporate the necessary components and to remove any components that may no longer be required, e.g. the A/D converter 148.

Figure 24:
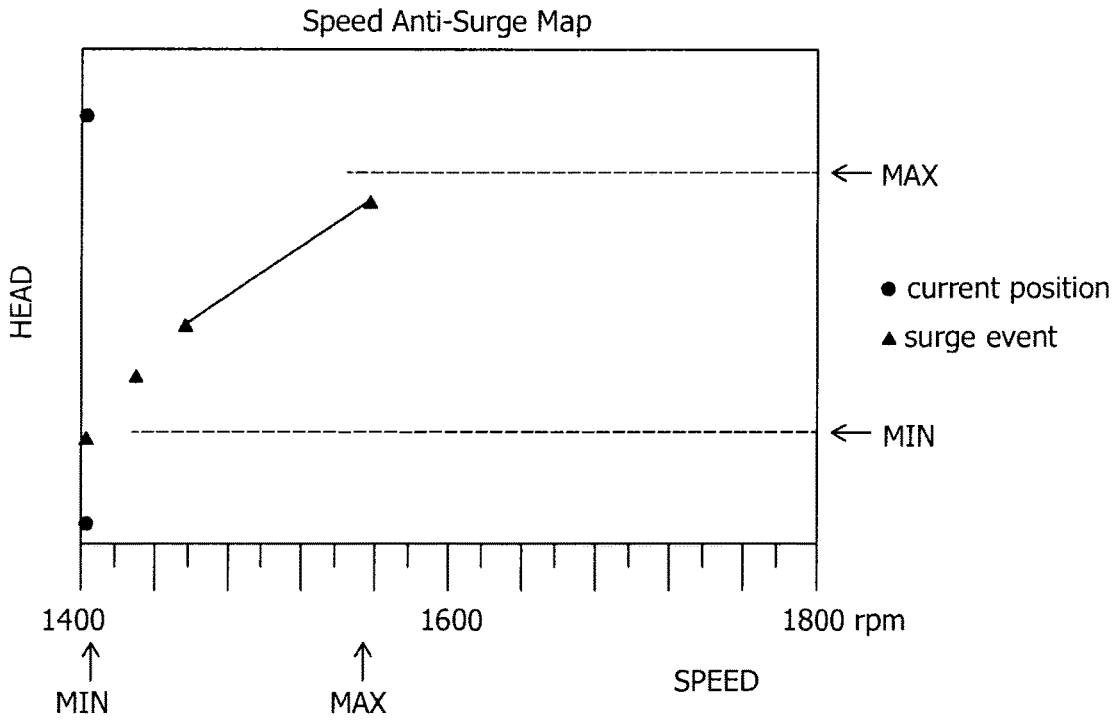
FIG. 24 is a graph showing a speed anti-surge map for an embodiment of an exemplary HVAC system.

Referring next to FIG. 24, an anti-surge map is shown. The control system for anti-surge may use multiple equations over smaller differential pressure ranges to create a piece-wise defined curve for head pressure versus speed.

FIG. 28 illustrates a logic diagram for calculating the minimum turbine speed (MS) and the minimum pre-rotation vane position (MV) in step 502 of FIG. 26. The logic begins in block 310, where the evaporator pressure is measured by the evaporator refrigerant vapor pressure sensor and a representative signal is sent to the control panel 90. In block 320, refrigerant condenser pressure is measured by the refrigerant condenser pressure sensor and a representative signal is sent to the control panel 90. In block 330, a representative value of the system pressure differential or head (PD), which is the difference between the refrigerant condenser pressure and evaporator pressure, is determined by subtracting the evaporator pressure taken in block 310 from the condenser pressure taken in block 320. The system pressure differential is then used in calculating both the minimum turbine speed (MS) and the minimum pre-rotation vane position (MV).

To determine the minimum pre-rotation vane position (MV), the process starts in block 340, where a minimum desired vane position at high head (MVP1) for the PRV 80 is established or set as a percentage of the fully open position for the PRV 80. In block 350, a minimum desired vane position at low head (MVP2) is established or set as a percentage of the fully open position for the PRV 80. In block 360, a maximum desired pressure differential or pressure delta at high head (PD1) for each compressor 12, 12*a* is set or established. In block 370, a minimum desired pressure differential or pressure delta at low head (PD2) for each compressor 12, 12*a* is set or established. The established values in blocks 340, 350, 360 and 370, can be entered into user interface 94 and stored in memory 92. Preferably, the values in blocks 340, 350, 360 and 370 remain constant during operation of the system 10, however, the values may be overwritten or adjusted through entry at the user interface 94 or by operation of the central control algorithm. Next, in block 380, the values from blocks 340, 350, 360, and 370 and the pressure differential (PD) from block 330 are used in a minimum vane position calculation to determine minimum pre-rotation vane position (MV). The minimum pre-rotation vane position (MV) is calculated as shown in equation 1.

$$MV=[((PD-PD2)(MVP1-MVP2))/(PD1-PD2)]+MVP2 \quad [1]$$

This calculated minimum pre-rotation vane position (MV), which is a percentage of the fully open position, is returned to step 502 in FIG. 26.

To determine the minimum turbine speed (MS), the process starts in block 440, where a desired speed at high head (MSP1) for turbine 14 and compressors 12, 12*a* is set or established. In block 450, a desired speed at low head (MSP2) for turbine 14 and compressors 12, 12*a* is set or established. In addition and as discussed above, in block 360, a maximum desired pressure differential or pressure delta at high head (PD1) for each compressor 12, 12*a* is set or established. In block 370, a minimum desired pressure differential or pressure delta at low head (PD2) for each compressor 12, 12*a* is set or established. In one embodiment, the value for blocks 440 and 450 can be set or established based upon startup testing of system 10 with selected PDs and loads, although established values from other chillers of similar design may also be used in blocks 440 and 450.

The established values in blocks 440, 450, 360 and 370, can be entered into user interface 94 and stored in memory 92. Preferably, the values in blocks 440, 450, 360 and 370 remain constant during operation of the system 10, however, the values may be overwritten or adjusted through entry at the user interface 94 or by operation of the central control algorithm. Next, in block 480, the values from blocks 440, 450, 360, and 370 and the pressure differential (PD) from block 330 are used in a minimum speed calculation to determine a calculated minimum turbine speed (CMS) as shown in equation 2.

$$CMS=[((PD-PD2)(MSP1-MSP2))/(PD1-PD2)]+MSP2 \quad [2]$$

In block 490, the minimum rated speed for turbine 14 and compressors 12, 12*a* (SSP2) is set or established. Preferably, SSP2 is predetermined by the specific turbine 14 and compressors 12, 12*a* incorporated into the system 10, and programmed into the control panel 90. In block 500, the minimum turbine speed (MS) is determined to be the larger of SSP2 and CMS. This determined minimum turbine speed (MS) is returned to step 502 in FIG. 26.

Referring back to FIG. 30, in step 504, the leaving chilled liquid temperature (LCLT) is compared to the desired setpoint temperature for the LCLT (SPT). If the LCLT is greater than the SPT, then the process proceeds to step 506. Otherwise, the process proceeds to step 602 as illustrated in FIG. 31. In step 506, the HGV 84 is checked to determine whether it is open or closed. If the HGV 84 is open in step 506, the process proceeds to step 508 to control the system components in accordance with an HGV control mode, as discussed in greater detail below, and the process returns to step 502. If the HGV 84 is closed in step 506, the process proceeds to step 510 to determine whether the PRV 80 are in a fully open position.

The HGV control mode operation from step 508 can load unique tuning parameters to control the operation of the HGV 84 thus ensuring that the control algorithm response matches the system response to a change in the HGV position. In the HGV control mode of operation, during the loading of each compressor 12, 12*a*, the HGV 84 is ramped closed, the PRV 80 are maintained at the minimum pre-rotation vane position (MV) and the speed of the turbine 14 is maintained at the minimum turbine speed (MS). As the system pressure differential (condenser pressure minus evaporator pressure) increases, the outputs of the minimum turbine speed (MS) and the minimum pre-rotation vane position (MV) from step 502 can also increase. As a result of the change in the minimum turbine speed (MS) and the minimum pre-rotation vane position (MV) the corresponding control commands or signals for the speed set point to control the governor valve 48 and thereby the speed of the turbine 14 and compressors 12, 12*a* and the vane control to control the position of the PRV 84 are immediately set to the appropriate higher values to prevent surging. If the load on each compressor 12, 12*a* is light and the LCLT decreases to within 2° F. of the SPT, the HGV control mode can begin modulating the HGV 84 to prevent overshooting of the SPT as the chilled water loop is pulled down to the SPT.

Referring back to step 510, if the PRV 80 are not fully open, the process proceeds to step 512 to control the system components in accordance with a PRV control mode, as discussed in greater detail below, and the process returns to step 502. If the PRV 80 are fully open in step 510, the process proceeds to step 514 to control the system components in accordance with a speed control mode, as discussed in greater detail below, and the process returns to step 502.

The PRV control mode operation from step 512 can load unique tuning parameters to control the operation of the PRV 80 thus ensuring that the control algorithm response matches the system response to a change in the PRV position. In the PRV control mode of operation, during the loading of each compressor 12, 12*a*, the HGV 84 is maintained in the closed position, the PRV 80 are ramped to a fully open position from the larger of the minimum start-up value position (PRVM) or the minimum pre-rotation vane position (MV) and the speed of the turbine 14 is maintained at the minimum turbine speed (MS). As the system pressure differential (condenser pressure minus evaporator pressure) increases, the output of the minimum turbine speed (MS) from step 502 can also increase. As a result of the change in the minimum turbine speed (MS) the corresponding control commands or signals for the speed set point to control the governor valve 48 and thereby the speed of the turbine 14 and compressors 12, 12*a* are immediately set to the appropriate higher values to prevent surging. If the load on each compressor 12, 12*a* is light and the LCLT decreases to within 2° F. of the SPT, the PRV control mode can begin modulating the PRV 80 to prevent overshooting of the SPT as the chilled water loop is pulled down to the SPT.

The speed control mode operation from step 514 can load unique tuning parameters to control the speed setpoint (SPT) thus ensuring that the control algorithm response matches the system response to a change in the speed of the turbine 14 and compressors 12, 12*a*. In the speed control mode of operation, during the loading of each compressor 12, 12*a*, the HGV 84 is maintained in the closed position, the PRV 80 are maintained in an open position (at least 90% of the fully open position) and the speed of the turbine 14 is increased from the minimum turbine speed (MS) to the desired speed to maintain the leaving chilled liquid temperature (LCLT) at setpoint (SPT).

Referring now to FIG. 27, in step 602, the capacity control program is checked to determine if it is operating in the speed control mode. If the capacity control program is not operating in the speed control mode, the process proceeds to step 604. However, if the capacity control program is operating in the speed control mode in step 602, the process then proceeds to step 608. In step 608, the speed of the turbine (TS) is checked to determine if it is equal to the minimum turbine speed (MS). If TS is equal to MS in step 608, then the process proceeds to step 512 to control the system components in accordance with the PRV control mode and the process returns to step 502. However, if TS is not equal to MS in step 608, the system components are controlled in accordance with the speed control mode, step 514, and the process returns to step 502.

As discussed above, the speed control mode operation from step 514 can load unique tuning parameters to control the speed of the turbine 14 and compressors 12, 12*a*. In the speed control mode of operation, during the unloading of each compressor 12, 12*a*, the HGV 84 is maintained in the closed position, the PRV 80 are maintained in an open position (at least 90% of the fully open position) and the speed of the turbine 14 is decreased toward the minimum turbine speed (MS) to maintain the leaving chilled liquid temperature (LCLT) at setpoint (SPT). As the system pressure differential decreases, the output of the minimum turbine speed (MS) from step 502 can also decrease because each compressor 12, 12*a* is capable of stable operation with less refrigerant gas flow. As a result of the change in the minimum turbine speed (MS) the corresponding control commands or signals for the speed set point to control the governor valve 48 and thereby the speed of the turbine 14 and compressors 12, 12*a* are set to the appropriate lower value to maintain stable operation.

In step 604, the capacity control program is checked to determine if it is operating in the PRV control mode. If the capacity control program is operating in the PRV control mode in step 604, the process then proceeds to step 610. In step 610, the position of the pre-rotation vanes (PRVP) is checked to determine if it is equal to the minimum pre-rotation vane position (MV). If PRVP is equal to MV in step 610, then the process proceeds to step 508 to control the system components in accordance with the HGV control mode and the process returns to step 502. However, if PRVP is not equal to MV in step 610, the system components are controlled in accordance with the PRV control mode, step 512, and the process returns to step 502.

As discussed above, the PRV control mode operation from step 512 can load unique tuning parameters to control operation of the PRV 80. In the PRV control mode of operation, during the unloading of each compressor 12, 12*a*, the HGV 84 is maintained in the closed position, the speed of the turbine 14 is maintained at the minimum turbine speed (MS), and the PRV 80 are ramped to the minimum pre-rotation vane position (MV) to maintain the leaving chilled liquid temperature (LCLT) at setpoint (SPT). As the system pressure differential decreases, the output of the minimum turbine speed (MS) from step 502 can also decrease. As a result of the change in the minimum turbine speed (MS) the corresponding control commands or signals for the speed set point to control the governor valve 48 and thereby the speed of the turbine 14 and compressors 12, 12*a* are set to the appropriate lower values after a programmable time delay to maintain maximum efficiency of operation.

As the PRV 80 are closed to the minimum desired vane position at low head (MVP2) to correspond to the reduction in the capacity of compressors 12, 12*a*, the PRV 80 are not further closed to reduce capacity. As discussed above with regard to the calculation for MV, as the system differential pressure (PD) approaches the minimum desired pressure differential at low head (PD2), the minimum pre-rotation vane position (MV) approaches the minimum desired vane position at low head (MVP2). Accordingly, when PD reaches PD2, MV is equal to MVP2, and PRV 80 are positioned in the lowest desired percent full open vane position, i.e., PRVP is equal to MV. As the load continues to drop, the low system pressure differential (PD) introduces a desirability to modulate HGV 84 in the HGV control mode, see step 610, in response to changing temperatures, since compressors 12, 12*a* are operating at a minimal desired pressure differential and therefore close to a surge condition.

In alternate embodiment, to avoid operations at a very low system pressure differentials, such as, for example 20 to 40 psi, the capacity control program may be used to prevent the system pressure differential (PD) from decreasing to or below the minimum desired pressure differential at low head (PD2). To accomplish this operational control mode with a decreasing load, the PRV 80 are closed to a pre-selected position and, upon further load reduction, the HGV 84 is opened and operated in the HGV control mode when the PRV 80 reach the preselected position. With reference to FIG. 28, block 400 is an adjustable setpoint (HGVRAT) selected by a user and input into user interface 94. The setpoint of block 400 is used to maintain a minimum selected system pressure differential (PD) that is preferably greater than PD2. In block 410, the minimum pre-rotation vane position (MV %) is determined to be the larger of HGVRAT and MV (from block 380). The capacity control program then determines whether the PRV 80 have reached the corresponding minimum pre-rotation vane position (MV %) from block 410. In this alternate embodiment, step 610 from FIG. 27 is changed to compare PRVP and MV % (instead of MV). If PRVP has not reached MV %, the PRV 80 are used to control capacity in the PRV control mode in step 512. If PRVP has reached MV %, the PRV 80 are maintained at MV % and the HGV 84 is opened for operation in the HGV control mode in step 508.

Referring back to step 604, if the capacity control program is not operating in the PRV control mode, the process proceeds to step 508 to control the system components in accordance with the HGV control mode and the process returns to step 502. As discussed above, the HGV control mode operation from step 508 can load unique tuning parameters to control operation of the HGV 84. In the HGV control mode of operation, during the unloading of each compressor 12, 12*a*, the speed of the turbine 14 is maintained at the minimum turbine speed (MS), the PRV 80 are maintained at the minimum pre-rotation vane position (MV), or in an alternate embodiment MV %, and the HGV 84 is opened to maintain the leaving chilled liquid temperature (LCLT) at setpoint (SPT). As the system pressure differential decreases, the outputs of the minimum turbine speed (MS) and the minimum pre-rotation vane position (MV) from step 502 can also decrease. As a result of the change in the minimum turbine speed (MS) and the minimum pre-rotation vane position (MV) the corresponding control commands or signals for the speed set point to control the governor valve 48 and thereby the speed of the turbine 14 and compressors 12, 12*a* and the vane control to control the position of the PRV 84, are set to the appropriate lower values after a programmable time delay to maintain maximum efficiency of operation.

The capacity control program can override the normal control operation in response to certain events. One example of an override event is the detection of a high or low refrigerant pressure in the evaporator 18 or the refrigerant condenser 16. If a measured evaporator pressure or condenser pressure is determined to be outside of the acceptable range of operation, i.e., the pressure is either too high or too low, the capacity control program operates in an override control mode to unload the system 10 in a manner similar to that shown in FIG. 27. The capacity control program uses information, e.g., a tieback signal, from the control commands just before the override event in determining the appropriate control commands for the override event. This use of information in transitioning between normal operation and override operation can provide a bumpless transition between the two modes of operation. The unloading of the system is controlled in response to the override control algorithm and the system pressure differential, thus preventing unsafe operation and an unnecessary shutdown. Once the monitored parameter has returned to within the acceptable range for a predetermined amount of time the capacity control can return to normal control operation using a bumpless transition similar to that described above.

Another example of an override event can occur when, during high load or pulldown conditions, the turbine 14 may be capable of producing more torque than the acceptable torque rating for the compressor bearings. The governor valve actuator output is monitored to determine if the speed control mode operation from step 514 attempts to open the governor valve 48 more than a preset value (determined by field testing at start up). If the governor valve 48 is to be opened to a position greater than the preset value, the capacity control program operates in an override control mode to unload the system 10 in a manner similar to that shown in FIG. 27. The capacity control program uses information, e.g., a tieback signal, from the control commands just before the override event in determining the appropriate control commands for the override event. This use of information in transitioning between normal operation and override operation can provide a bumpless transition between the two modes of operation. The unloading of the system is controlled in response to the override control algorithm and the system pressure differential, thus preventing unsafe operation and an unnecessary shutdown. With the load reduced, the turbine 14 can begin to accelerate and the speed control mode of operation can begin to close the governor valve 48, thus limiting the torque output of the turbine 14. Once the governor valve actuator output has returned to within the acceptable range for a predetermined amount of time, the capacity control can return to normal control operation using a bumpless transition similar to that described above.

Still another example of an override event can occur when, during high load or pulldown conditions, the turbine 14 may be capable of producing more torque or power than the acceptable torque rating for the compressor bearings. However, in this example, the turbine first stage pressure is monitored instead of the governor valve actuator output. A setpoint for the turbine first stage pressure is determined based on the steam inlet temperature and pressure so that the override controller can automatically adapt to fluctuations in the quality of the steam supplied to the turbine inlet. If the turbine first stage pressure increases above the calculated set point, the capacity control program operates in an override control mode to unload the system 10 in a manner similar to that shown in FIG. 27. The capacity control program uses information, e.g., a tieback signal, from the control commands just before the override event in determining the appropriate control commands for the override event. This use of information in transitioning between normal operation and override operation can provide a bumpless transition between the two modes of operation. The unloading of the system is controlled in response to the override control algorithm and the system pressure differential, thus preventing unsafe operation and an unnecessary shutdown. With the load reduced, the turbine 14 can begin to accelerate and the speed control mode of operation from step 514 can begin to close the governor valve 48, thus reducing the first stage pressure and limiting the torque output of the turbine 14. Once the turbine first stage pressure has returned to a value that is less than the calculated setpoint for a predetermined amount of time, the capacity control can return to normal control operation using a bumpless transition similar to that described above.

In another embodiment of the present invention, the capacity control program can be used with a fixed speed compressor. During operation at fixed speed, the primary method of capacity control for compressors 12, 12*a* involves adjustment of PRV 80 and HGV 84. The capacity control program preferably adjusts the PRV 80 before adjusting the HGV 84 to provide greater system efficiency during fixed speed operation.

As discussed above, a change in load is detected by a change in the leaving LCLT. Similar to the PRV control process discussed above, the capacity control program sends a signal to adjust PRV 80 to a calculated minimum vane position to satisfy the load condition. The calculated minimum vane position is preferably a function of the pressure differential between refrigerant condenser 16 and evaporator 18. While the PRV 80 are adjusted to reduce capacity, the HGV 84 remains closed. At very low pressure differentials, as the calculated minimum vane position approaches zero, capacity is reduced by incrementally opening the HGV 84.

In some operational modes, it may be desirable to operate with the PRV 80 fully closed. With the PRV 80 fully closed, HGV 84 is modulated for capacity control based upon leaving chilled liquid temperature. If the load continues to decrease with the PRV 80 fully closed, the leaving chilled liquid temperature will continue to decrease. In the event that the leaving chilled liquid temperature decreases to below a predetermined amount lower than a predetermined setpoint, the HGV 84 is modulated to maintain the leaving chilled liquid temperature at the desired setpoint.

Referring next to FIGS. 29A through 29D, an exemplary embodiment of a control scheme is shown for a steam turbine-driven dual-compressor system.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A heat pump system comprising:

a steam system comprising a steam supply, a steam turbine and a steam condenser connected in a steam loop, wherein the steam turbine comprises a rotary drive shaft extending axially from a first end and a second end of the steam turbine;

a refrigerant system comprising a first compressor and a second compressor, a refrigerant condenser, and an evaporator connected in a refrigerant loop;

the first compressor coupled to a first portion of the rotary drive shaft extending from the first end of the steam turbine and the second compressor coupled to a second portion of the rotary drive shaft extending from the second end of the steam turbine, wherein the first compressor and the second compressor are connected in parallel in the refrigerant loop, and wherein the first compressor and the second compressor share a cooling load equally during operation of the heat pump system;

a magnetic sensor coupled to a rotating surface of the rotary drive shaft, wherein the magnetic sensor is configured to monitor magnetic properties of the rotating surface, and wherein the magnetic properties are indicative of a motion of the rotary drive shaft; and a controller configured to adjust a position of pre-rotation vanes, a position of a hot gas bypass valve, a position of a variable geometry diffuser, or any combination thereof, of the first compressor, the second compressor, or both, based at least on the magnetic properties monitored by the magnetic sensor and a pressure differential of refrigerant in the refrigerant condenser and the evaporator.

2. The heat pump system of claim 1, wherein the controller is communicatively coupled to a first control panel and a second control panel, the first compressor comprises the first control panel and the second compressor comprises the second control panel, wherein the first control panel and the second control panel are configured to detect a surge condition of the first compressor and the second compressor, respectively, and, in response to detecting the surge condition, the controller, the first control panel, the second control panel, or any combination thereof, are configured to adjust a speed of the steam turbine.

3. The heat pump system of claim 2, wherein the second compressor is configured to operate at a setpoint determined by the first control panel of the first compressor.

4. The heat pump system of claim 3, wherein the setpoint is determined by one of a capacity control algorithm, a surge control algorithm, or a stability control algorithm.

5. The heat pump system of claim 1, wherein the first compressor is a mirror image of the second compressor to provide symmetry at the first portion and the second portion of the rotary drive shaft of the steam turbine, and the first compressor is configured to rotate in the same rotational direction as the second compressor while facing in an opposite direction of the second compressor with respect to the steam turbine.

6. The heat pump system of claim 1, wherein the first compressor and the second compressor are identical and are coupled to the rotary drive shaft of the steam turbine facing the same direction.

7. The heat pump system of claim 1, wherein a lubricating fluid is configured to mix with a refrigerant in the first compressor and the second compressor, and the heat pump system further comprises:

a sump configured to receive the lubricating fluid, the refrigerant, and combinations thereof from the first compressor and the second compressor;

a lubricating circuit for distributing the lubricating fluid from the sump to portions of the first compressor and the second compressor requiring lubrication; and a refrigerant pressure reducer between the sump and a low pressure region of the heat pump system to reduce an amount of the refrigerant mixed with the lubricating fluid, wherein the refrigerant pressure reducer is configured to lower a first refrigerant gas pressure within the sump below that of a second refrigerant gas pressure within the low pressure region of the heat pump system, while lowering a temperature of the refrigerant within the sump, and the refrigerant pressure reducer is configured to transfer refrigerant gas from the sump to the low pressure region of the heat pump system while cooling the lubricating fluid.

8. The heat pump system of claim 7, wherein the refrigerant pressure reducer is an auxiliary compressor.

9. The heat pump system of claim 8, wherein the auxiliary compressor is in fluid communication with a gas volume of the sump and the low pressure region of the heat pump system, the auxiliary compressor is configured to draw the refrigerant gas from the sump and discharge compressed refrigerant gas to the low pressure region of the heat pump system, the auxiliary compressor is configured to adjust a sump pressure and a sump temperature based on an evaporation temperature and an evaporation pressure of the refrigerant in the heat pump system.

10. The heat pump system of claim 7, wherein the refrigerant pressure reducer is an ejector pump.

11. The heat pump system of claim 7, wherein the refrigerant pressure reducer is an auxiliary condenser, wherein cooling fluid is configured to be directed to the auxiliary condenser from an external cooling source in response to determining that the heat pump system is in a coastdown mode, or the steam turbine is in a post-cooldown slow roll mode, or that a saturation temperature in the sump exceeds a threshold temperature.

12. The heat pump system of claim 1, wherein the controller comprises a central control algorithm and a capacity control algorithm, wherein a processor of the controller is configured to execute the central control algorithm to control operation of both the steam system and the refrigerant system, and wherein the processor is configured to execute the capacity control algorithm to adjust a speed of the steam turbine to control a capacity of the refrigerant system in response to feedback indicative of a leaving chilled liquid temperature and the pressure differential of refrigerant in the refrigerant condenser and the evaporator.

13. The heat pump system of claim 1, wherein the controller is configured to execute a capacity control algorithm to adjust the position of the pre-rotation vanes to control a capacity of the refrigerant system in response to feedback indicative of a leaving chilled liquid temperature and the pressure differential of refrigerant in the refrigerant condenser and the evaporator.

14. The heat pump system of claim 13, wherein the controller is configured to execute the capacity control algorithm to adjust the position of the hot gas bypass valve to control the capacity of the refrigerant system in response to the feedback indicative of the leaving chilled liquid temperature and the pressure differential of refrigerant in the refrigerant condenser and the evaporator.

15. The heat pump system of claim 14, wherein the controller is configured to execute the capacity control algorithm to control the position of the pre-rotation vanes, the position of the hot gas bypass valve, and the speed of the first compressor and the second compressor to prevent the first compressor and the second compressor from operating at a surge condition.

16. The heat pump system of claim 1, wherein the first compressor is coupled to the first portion of the rotary drive shaft via a first clutch and the second compressor is coupled to the second portion of the rotary drive shaft via a second clutch.

17. The heat pump system of claim 1, wherein the first compressor is coupled to the first portion of the rotary drive shaft and the second compressor is coupled to the second portion of the rotary drive shaft via a respective one of the following: an electromagnetic coupling, a pneumatic coupling, or an air clutch.

18. The heat pump system of claim 1, wherein the controller is configured to adjust the position of the variable geometry diffuser of the first compressor and the second compressor to control surge and stall in the first compressor and the second compressor respectively.

19. The heat pump system of claim 1, wherein the magnetic sensor comprises a first eddy-current proximity probe and a second eddy-current proximity probe, wherein the first compressor comprises the first eddy-current proximity probe and the second compressor comprises the second eddy-current proximity probe.

20. The heat pump system of claim 19, wherein the first compressor comprises a first bearing and a first counterbore surface, the first counterbore surface comprising a first plurality of internally threaded holes arranged to receive first bolts for pulling the first bearing from the first compressor shaft, wherein the second compressor comprises a second bearing and a second counterbore surface, the second counterbore surface comprising a second plurality of internally threaded holes arranged to receive second bolts for pulling the second bearing from the second compressor shaft.

* * * * *